United States Patent [19]

Rueb

[11] Patent Number: 5,033,797

[45] Date of Patent: Jul. 23, 1991

[54] METHOD OF AND APPARATUS FOR MAKING BRUSHES

[76] Inventor: Fritz Rueb, Oberfeldstrasse 1, D-7869 Schönau, Fed. Rep. of Germany

[21] Appl. No.: 543,352

[22] Filed: Jun. 25, 1990

[30] Foreign Application Priority Data

Jun. 24, 1989 [DE] Fed. Rep. of Germany ..... 3920769
Jun. 24, 1989 [DE] Fed. Rep. of Germany ..... 3920770

[51] Int. Cl.[5] ..... A46D 1/08

[52] U.S. Cl. ..... 500/5; 300/9; 300/21

[58] Field of Search ..... 300/2-11, 300/21

[56] References Cited

U.S. PATENT DOCUMENTS

| | | | |
|---|---|---|---|
| 413,788 | 10/1889 | Nimschke | 300/9 X |
| 562,930 | 6/1896 | Shrady | 300/9 |
| 824,503 | 6/1906 | Morrison | 300/9 |
| 985,806 | 3/1911 | Hoover et al. | 300/9 X |
| 3,230,015 | 1/1966 | Iasillo . | |
| 4,609,228 | 9/1986 | Bickel | 300/5 X |
| 4,610,481 | 9/1986 | Steinebrunner . | |
| 4,647,113 | 3/1987 | Steinebrunner . | |
| 4,904,025 | 2/1990 | Steinebrunner et al. . | |

FOREIGN PATENT DOCUMENTS

| | | |
|---|---|---|
| 845933 | 6/1953 | Fed. Rep. of Germany . |
| 1769825 | 5/1958 | Fed. Rep. of Germany . |
| 1632375 | 11/1970 | Fed. Rep. of Germany . |
| 2335468 | 2/1975 | Fed. Rep. of Germany . |
| 2539417 | 3/1976 | Fed. Rep. of Germany . |
| 2731762 | 1/1979 | Fed. Rep. of Germany . |
| 2808966 | 9/1979 | Fed. Rep. of Germany . |
| 3405001 | 8/1985 | Fed. Rep. of Germany . |
| 3616976 | 11/1987 | Fed. Rep. of Germany . |

*Primary Examiner*—Mark Rosenbaum
*Attorney, Agent, or Firm*—Peter K. Kontler

[57] ABSTRACT

Individual bristles and/or batches of bristles are withdrawn from one or more magazines and are mechanically or pneumatically transferred to positions of alignment with the sockets of one or more forms. The individual bristles and/or batches of bristles are thereupon drawn into the aligned sockets by suction prior to being welded or glued to an adapter which constitutes or forms part of a brush body and defines the open ends of sockets during drawing of bristles into the form or forms.

70 Claims, 8 Drawing Sheets

FIG.2
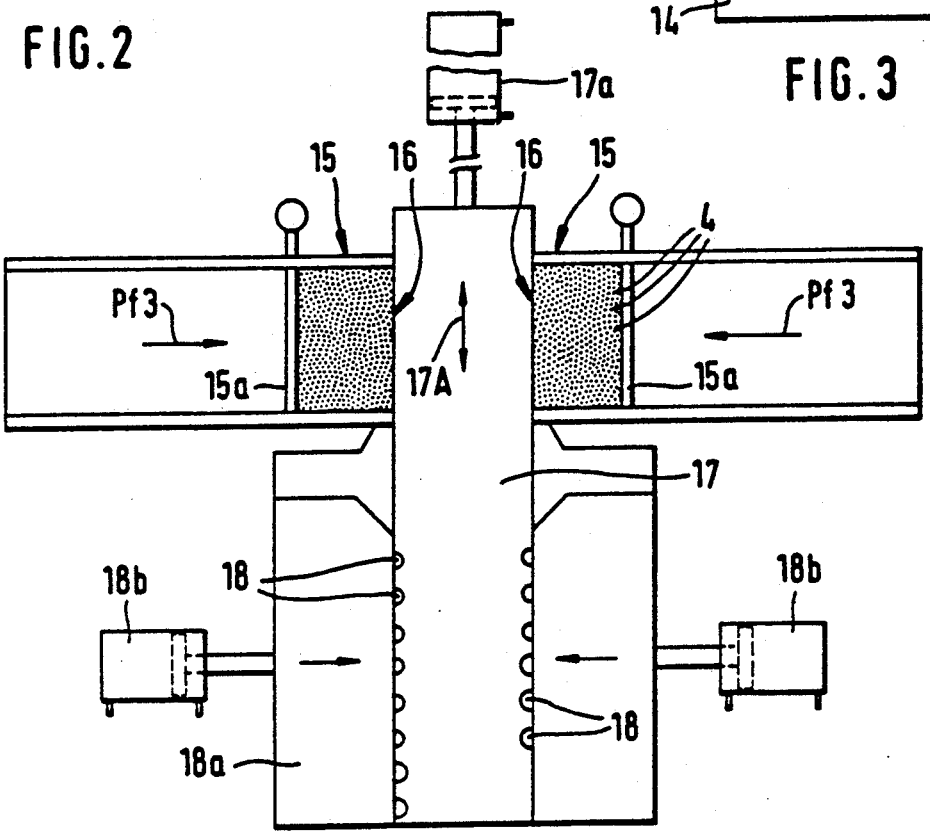
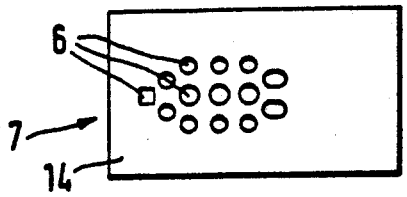
FIG.3
FIG.1a
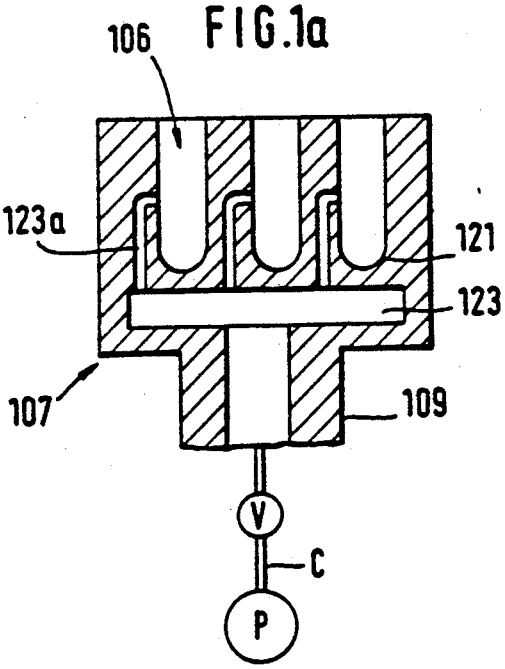
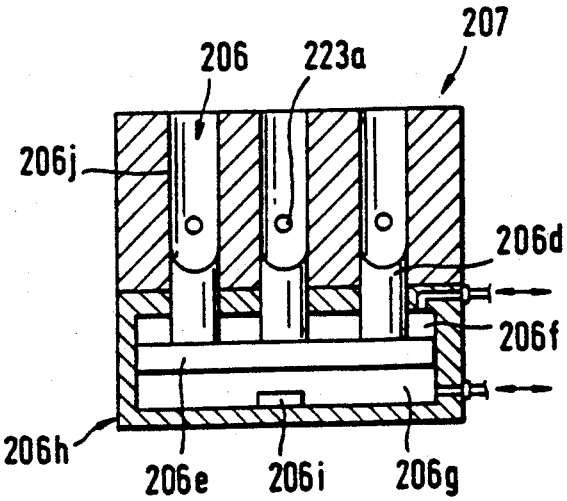
FIG.1b

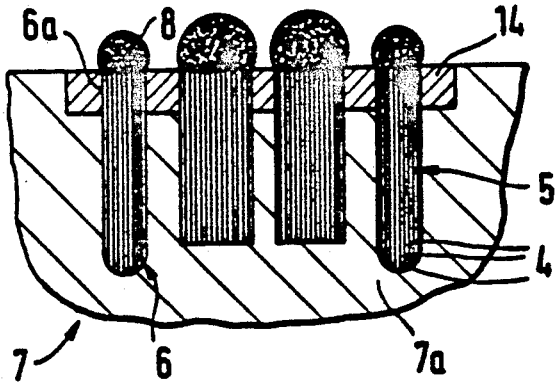
FIG.5
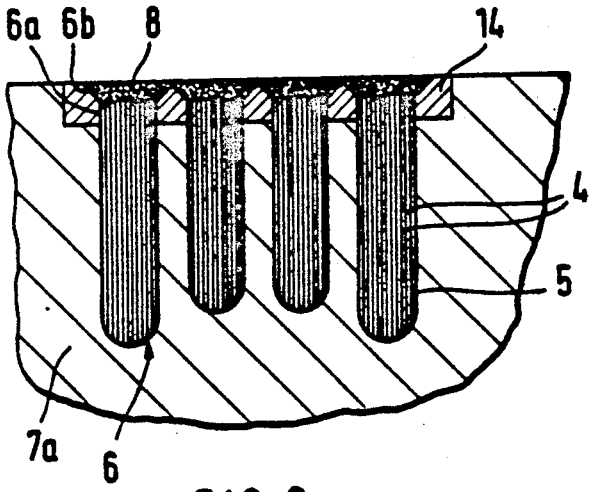
FIG.6
FIG.7
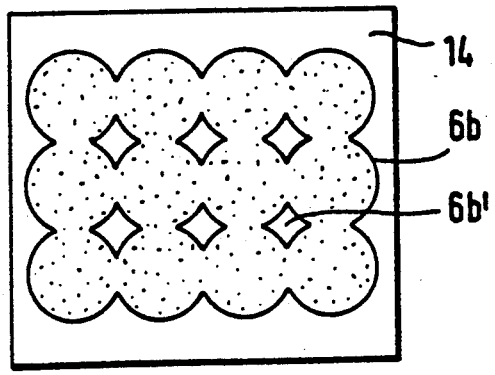
FIG.8
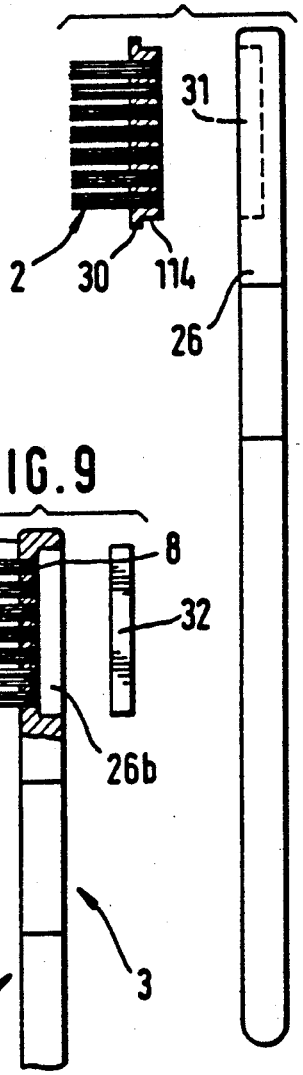
FIG.9
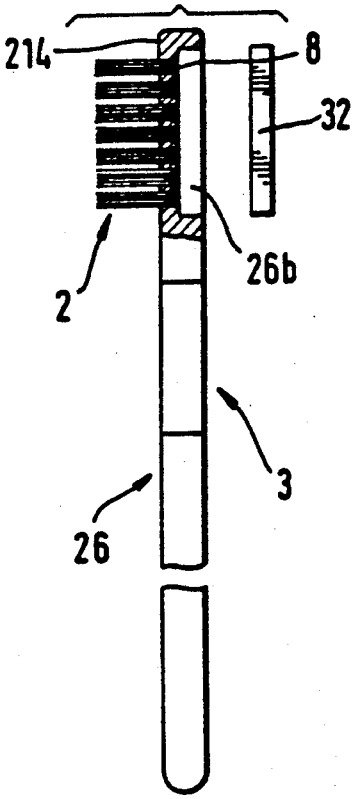

FIG. 10
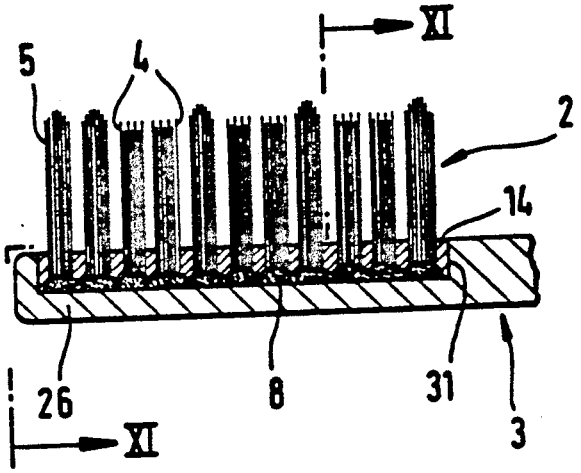
FIG. 12
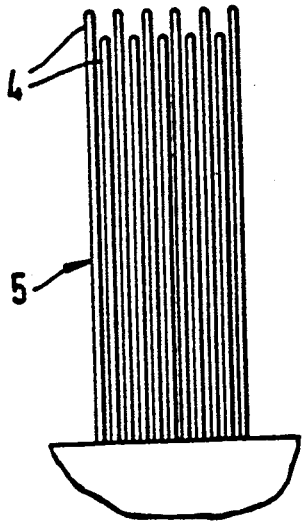
FIG. 11
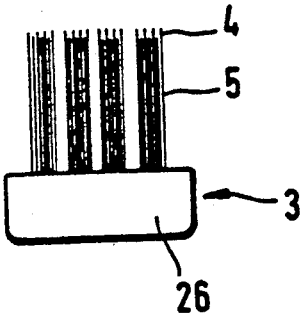
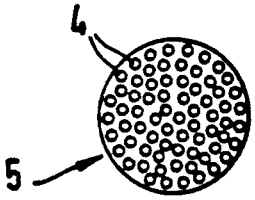
FIG. 13
FIG. 11a
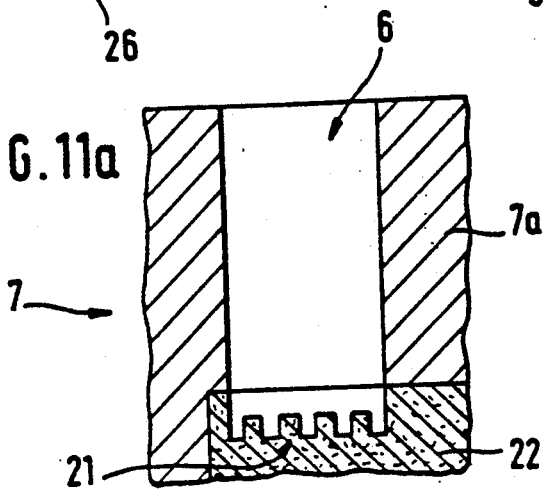

METHOD OF AND APPARATUS FOR MAKING BRUSHES

BACKGROUND OF THE INVENTION

The invention relates to improvements in methods of and in apparatus for making brushes, brooms and the like (hereinafter called brushes). More particularly, the invention relates to improvements in methods of and in apparatus for making brushes containing bristles which are conveyed by a gaseous fluid.

German Pat. No. 845,933 to Schiffer et al. discloses a brush making apparatus wherein tufts of bristles are transported from a roll of convoluted bristles to the brush making station The making of tufts involves withdrawal of bristles from the roll and introduction of batches of bristles into through holes which are provided in a form. The leading ends of the bristles project beyond the respective holes so that they can be bonded to a brush body. The bristles are then severed at a distance from the brush body and the thus obtained free ends of bristles are trimmed. Such trimming often involves the formation of sharp edges which are likely to injure the gums of a user if the tufts are assembled with brush bodies to form toothbrushes. The same applies if the finished product is a hair brush, i.e., the sharp edges of free ends of the bristles are likely to injure or irritate the skin of the user. The situation is aggravated if the exposed ends or tips of the tufts are to be trimmed for the purpose of assuming a predetermined (e.g., conical or hemispherical) configuration which enables the free ends of the bristles to penetrate into spaces between the teeth of a user if the ultimate product is a toothbrush. Such shaping of the tips of tufts increases the danger of injury or irritation because the sharp edges of all or nearly all bristles in each tuft are free to come into contact with the gums in the mouth or with the skin on the head of the user of a toothbrush or hairbrush employing such tufts.

Attempts to avoid the aforediscussed drawbacks of conventional brushes involve a treatment of the free ends of bristles, namely a treatment which results in the making of rounded ends of bristles. However, such treatment is possible only if the tips of tufts of bristles are flat Moreover, the treatment does not result in complete elimination of sharp edges.

Published German patent application No. 23 35 468 of Lewis discloses a method of and an apparatus for gathering bristles into tufts which are thereupon assembled with brush bodies. The bristles consist of a synthetic material and are withdrawn from a magazine by a tool having hollow tubular receptacles for batches of bristles. A drawback of this apparatus is that numerous bristles are deformed as a result of penetration of tubular receptacles into the magazine. Misalignment of bristles in the magazine prevents complete filling of receptacles with bristles so that the number of bristles in finished tufts departs from the optimum or desired number. In addition, the apparatus is rather complex and its output is unsatisfactory.

Published German patent application No. 34 05 001 of Bickel discloses a method of making brushes, brooms and like products. Bristles are assembled into tufts, and the bristles of each tuft are bonded to each other prior to being transported, by streams of compressed air, to the brush or broom making station. The pneumatic conveyor system employs conduits which can guide finished tufts (i.e., tufts of bristles which are already bonded to each other) but could not properly guide loose bristles. Loose bristles in a stream of compressed air or another compressed gaseous fluid are particularly likely to jam in arcuate sections of a conduit and at locations where they are caused to enter or leave the conduit. The making of finished tufts ahead of the pneumatic conveyor system involves losses in time and additional expenses because the bristles of each tuft must be welded to each other prior to transport to the brush or broom forming station where the tufts are affixed (e.g., welded) to the bodies of brushes or brooms. Frequent interruptions of pneumatic transport as a result of jamming of conveyed tufts also affects the output of the apparatus.

Published German patent application No. 28 08 966 of Lorenz discloses a brush making apparatus wherein the bristles are transported exclusively by mechanical means. The apparatus comprises means for maintaining bristles in vertical positions and employs an ejector for finished brushes.

U.S Pat. No. 3,230,015 to Iasillo discloses a brush making machine wherein the bristles are drawn from a magazine and are thereupon manipulated by mechanical means. The device which draws bristles from the magazine has recesses for bunches of bristles.

The apparatus which is disclosed in published German patent application No. 1 632 375 of Neubauer et al. also employs a tool having recesses for batches of bristles which are drawn from the bottom end of an upright magazine.

Published German patent application No. 36 16 976 of Blankschein discloses a form with sockets for batches of bristles. The shape of the bottom wall in each socket determines the configuration of the tip of the respective tuft.

German Pat. No. 27 31 762 to Zahoransky discloses a brush making apparatus wherein brushes are assembled in a number of successive stages. Each of those stations where the treatment of partially finished brushes or component parts of brushes takes up relatively long intervals of time is designed to accept two identical partly finished brushes or two identical component parts of brushes. The bristles are transported exclusively by mechanical means, the same as in each of the aforediscussed prior publications save for the published application of Bickel.

German Utility Model No. 1 769 825 of Greiner & Hausser discloses welding of bristles in batches of bristles to each other prior to partial insertion of the thus obtained tufts into and their welding to the body of a toothbrush. Portions of tufts can be inserted into blind bores or holes of the brush body, or are caused to extend all the way through the brush body to be secured to the latter by welding or by the application of a layer of hardenable material.

Published German patent application No. 25 39 417 of Hersche discloses a brush with replaceable bristles. To this end, batches of bristles are inserted into the through holes of a form which is located between a pusher plate and a heating plate. The pusher plate bears against the first ends of bristles and forces the second ends of such bristles against the heating plate which causes the adjacent portions of the bristles to melt. Molten material of the bristles is gathered into a thin substrate which is integral with the bristles of all batches so that the batches form tufts of bristles. The substrate can be secured to the periphery of a drum or to another holder of tufts. If the tufts are damaged or destroyed, the substrate is removed from the holder and is replaced with a substrate carrying a requisite number of fresh tufts. The substrate and its tufts are intended for use in plants or machines wherein the bristles are subjected to extensive wear and wherein it pays to replace the bristles while retaining all other parts of a cleaning, brushing, smoothing or like machine.

OBJECTS OF THE INVENTION

An object of the invention is to provide a novel and improved method of gathering bristles into arrays which are ready to be anchored in the bodies of brushes.

Another object of the invention is to provide a simple and economical method of arraying bristles preparatory to attachment of bristles to the bodies of brushes.

A further object of the invention is to provide a novel and improved method of anchoring bristles in the bodies of brushes.

An additional object of the invention is to provide a novel and improved method of drawing bristles from one or more sources and a novel and improved method of conveying the thus withdrawn bristles to the brush forming or assembling station or stations.

Still another object of the invention is to provide a method which renders it possible to accumulate any desired arrays of bristles and tufts of bristles within short periods of time and which renders it possible to dispense with the trimming of tufts of bristles in a finished brush.

A further object of the invention is to provide a novel and improved method of making paintbrushes, such as artists' brushes.

Another object of the invention is to provide a novel and improved apparatus for the practice of the above outlined method.

An additional object of the invention is to provide a novel and improved source of bristles for use in the above outlined apparatus.

Another object of the invention is to provide novel and improved means for conveying bristles and tufts of bristles in the above outlined apparatus.

Still another object of the invention is to provide novel and improved forms for use in the above outlined apparatus.

A further object of the invention is to provide the apparatus with novel and improved means for imparting to the exposed ends of tufts of bristles a desired configuration in the course of the brush making operation.

Another object of the invention is to provide novel and improved brush bodies for assembly with bristles in the above outlined apparatus.

An additional object of the invention is to provide an apparatus which can assemble large quantities of simple or complex brushes per unit of time.

Another object of the invention is to provide the apparatus with novel and improved means for preventing misorientation and/or jamming of bristles on their way from the source of bristles to the brush assembling station or stations.

A further object of the invention is to provide a novel and improved apparatus for the making of toothbrushes.

Another object of the invention is to provide an apparatus which is constructed and assembled in such a way that its constituents can be installed at several spaced-apart locations to take advantage of the space which happens to be available in a bristle making and brush making plant.

An additional object of the invention is to provide an apparatus which is capable of reliably securing bristles and tufts of bristles to brush bodies in a simple and inexpensive way and at a frequency greatly exceeding the frequency at which brushes are assembled in conventional apparatus.

Another object of the invention is to provide an apparatus wherein the bristles of tufts of bristles need not be fixed to each other ahead of the brush assembling station or stations.

A further object of the invention is to provide an apparatus which can simultaneously produce two or more brushes and which can assemble brushes with bristles having identical or different colors, diameters, flexibilities and/or other characteristics.

SUMMARY OF THE INVENTION

One feature of the present invention resides in the provision of a method of making brushes from bristles (particularly thermoplastic bristles) in at least one form which is permeable to gaseous fluids and has at least one array of bristle-receiving open-ended sockets. The method comprises the steps of establishing and maintaining at least one supply of bristles (e.g., one or more magazines for large quantities of parallel bristles), conveying predetermined numbers of bristles from the at least one supply to the sockets of the at least one form including drawing air from the sockets through the permeable form so that the bristles are introduced into the sockets by suction and portions of the thus introduced bristles are located at the open ends of the respective sockets, and enlarging the portions of the bristles at the open ends of the respective sockets. The enlarging step can include heating the portions of properly introduced bristles at least close to the melting point of their thermoplastic material.

Each predetermined number of bristles can include a single bristle or a tuft of two or more at least substantially parallel bristles The conveying step can further comprise establishing discrete at least substantially sealed paths for the single bristles or for the tufts of bristles, and each such path extends from the at least one source to the respective sockets. The aforementioned drawing step then preferably includes drawing from the sockets air at such a rate that the drawing of air from the sockets entails the advancement of single bristles or tufts of bristles along the respective paths and into the respective sockets.

The conveying step can comprise (and preferably comprises) introducing the bristles into the respective sockets by moving the bristles substantially vertically downwardly so that the aforementioned portions of the bristles constitute the trailing upper end portions of the respective bristles.

The brushes can be made in and/or at least one form which has a main section with major parts of the sockets and a preferably detachable cover which overlaps the main section and has neighboring apertures constituting the open ends of the sockets in the form. The aforementioned portions of properly introduced bristles are confined in or extend outwardly beyond the respective apertures of the cover. The enlarging step can include bonding (e.g., welding or adhesively securing) portions of the bristles to the cover, bonding portions of bristles in neighboring apertures of the cover to each other, or bonding portions of two or more bristles in a properly introduced tuft to each other and/or to the cover and/or to portions of bristles forming tufts in neighboring sockets of the form.

The cover can be provided with at least one protuberance adjacent each of its apertures, and the enlarging step can include bonding portions of properly introduced bristles to the adjacent protuberances of the cover.

Each aperture of the cover can include a portion which is remote from the main section of the form and diverges in a direction away from the main section. The enlarging step can include heating portions of introduced bristles in the enlarged portions of the respective apertures. The portions of bristles in or at the enlarged portions of the respective apertures can be heated at least close to the melting point of thermoplastic material of the bristles in order to soften such portions of the bristles, and the enlarging step or a separate step which follows the enlarging step can include at least partially forcing the softened portions of bristles into the respective apertures of the cover. Such forcing step can include drawing the softened portions of bristles into the respective apertures by suction. If each socket receives a tuft of bristles, the forcing step can include or can entail bonding softened portions of the bristles in each tuft to each other and/or to the cover.

The cover is subsequently separated from the main section of the form, and the method can further comprise the step of securing the separated cover and the bristles to a brush body; such securing step can include mechanically fastening (e.g., by screws or the like or by a force fit) the separated cover to a brush body, welding (e.g., with a high-frequency welding apparatus) the separated cover to a brush body or bonding the separated cover to a brush body by resorting to a suitable adhesive. It is also possible to impart to the cover the shape of a brush body, either prior to attachment of the cover to the main portion of the form or subsequent to separation of the cover (with bristles) from the main section of the form.

Another feature of the invention resides in the provision of an apparatus for making brushes from bristles, particularly from thermoplastic bristles. The improved apparatus comprises at least one source of bristles, an assembling unit including at least one permeable form having bristle-receiving open-ended sockets or pockets, means for conveying predetermined numbers of bristles from the at least one source to the sockets including means for drawing air from the sockets through the permeable form so that the bristles are introduced into the sockets by suction and portions of the thus introduced bristles are located at the open ends of the respective sockets, and means for enlarging the aforementioned portions of introduced bristles at the open ends of the respective sockets.

The conveying means can further comprise a conduit for each predetermined number of bristles, i.e., one for each socket. The conduits have receiving ends at the at least one source and discharge ends at the open ends of the respective sockets. The means for drawing air then preferably includes means for advancing bristles by suction from the receiving ends toward and beyond the discharge ends of the conduits, i.e., into the respective sockets. The apparatus further comprises means for effecting a relative movement between the discharge ends of the conduits and the form, i.e., for moving the form relative to the discharge ends of the conduits and/or vice versa.

If the bristles are made of a thermoplastic material, the enlarging means preferably includes means for heating the aforementioned portions of properly introduced bristles at least close to the melting point of their thermoplastic material.

The at least one source and/or the conveying means can include means for maintaining the predetermined numbers of bristles in a first predetermined distribution, and the distribution of receiving ends of the conduits preferably matches such first distribution so that each receiving end is in a position to receive one of the predetermined numbers of bristles. Analogously, the sockets can be maintained in a second predetermined distribution which may but beed not match the first distribution, and the distribution of discharge ends of the conduits matches the second distribution so that each discharge end can admit one of the predetermined numbers of bristles into a discrete socket of the form.

Each conduit is or can be flexible, at least in the region of its receiving and/or discharging end. For example, each conduit can constitute or include a flexible hose having an inner diameter within a range of 0.1 to 20 mm, depending on the diameters and/or upon the number of bristles in the respective predetermined number.

The conveying means can further comprise a carrier (e.g., a plate- or strip-shaped support) for the receiving ends of the conduits. Such carrier can be provided with passages for the predetermined numbers of bristles, and each passage communicates with and preferably converges toward the receiving end of a discrete conduit. Each passage can have a minimum diameter which equals or approximates the inner diameter of the respective conduit.

The conveying means can further comprise a carrier or support (e.g., a plate or a strip) for the discharge ends of the conduits.

The discharge ends of the conduits can include or constitute or be aligned with flow restrictors; for example, each flow restrictor can constitute a venturi which causes an acceleration of air flowing from the conduit into the registering socket and an acceleration of the bristle or bristles in the conduit.

The source can comprise a plurality of magazines for accumulations of preferably parallel bristles, and means for transferring predetermined numbers of bristles from the magazines to the receiving ends of the conduits.

The assembling unit can comprise a plurality of forms, and the apparatus can comprise means (e.g., an endless belt or chain conveyor) for transporting the plurality of forms in a predetermined direction along a predetermined path having a first portion or station adjacent the discharge ends of the conduits and a second portion or station adjacent the enlarging means. The second portion of the path is located downstream of the first portion, and the path can have a third portion or station which is located downstream of the second portion and is adjacent a means for delivering suitable brush bodies from a source of brush bodies to successive forms reaching the third portion of the path. The third portion or a further portion or station of the path can be adjacent a means for treating the bristles in successive forms, e.g., for welding separable covers of successive forms (with the inserted bristles) to discrete brush bodies.

The arrangement may be such that the transporting means for the forms includes a first reach or stretch which defines at least the first and second portions or stations of the path, and a second reach or stretch which defines an additional portion or station of the path downstream of the aforediscussed (first and second or first, second and third) portions. Such apparatus can further comprise an ejector or other suitable means for segregating brushes the predetermined numbers of bristles from the respective forms in the additional portion of the path.

As mentioned above, each form can include a cover, and such form further includes a main section which overlaps the cover and is provided with blind holes or bores constituting portions of the sockets. The cover has apertures which register with the blind bores or holes and constitute the open ends of the respective sockets. The aforementioned portions of properly introduced bristles are located at the respective apertures of the cover. The apertures can include portions which are spaced apart from and diverge in a direction away from the main section of the form. Each aperture can communicate with at least one other aperture of the cover.

The source can comprise at least one magazine, and the apparatus can further comprise means for accumulating the predetermined numbers of bristles. Such accumulating means can include at least one transfer member with bristle-receiving pockets and means for moving the transfer member between at least one first position in which at least some of the pockets receive bristles from the at least one magazine and at least one second position in which the bristle-containing pockets are located externally of the magazine, e.g., in positions of register with the receiving ends of the aforementioned conduits or in register with the open ends of sockets in a form.

The sockets can include or constitute blind holes or bores, and the form can be provided with profiled (flat, concave, convex, undulate, sloping or conical) bottom surfaces in the blind holes to intercept and arrest the introduced bristles in predetermined axial positions with reference to the form.

The drawing means can comprise at least one suction port or channel provided in the form for each socket and extending substantially laterally of and communicating with the respective socket, and means (e.g., a suction chamber in the form) for evacuating air from the channels. The intake ends of the channels communicate with the respective sockets, and the discharge ends of the channels communicate with the suction chamber.

The form can include at least one foraminous insert which is adjacent and can define portions of the sockets, and the drawing means then comprises means for evacuating air from the sockets through the at least one foraminous insert. The evacuating means can include a suction chamber which is or can be provided in the form adjacent the at least one insert.

Each socket can form part of a discrete cylinder chamber in the form, and such form can further comprise a piston extending into each cylinder chamber and constituting an abutment for bristles which are introduced into the respective socket. This form can further comprise means for moving the pistons in the respective cylinder chambers to thus vary the effective depth of the sockets and to select the positions of the aforementioned portions of introduced bristles with reference to open ends of the respective sockets. For example, the pistons can be caused to shift the trailing ends of the bristles outwardly preparatory to welding of such trailing ends of the bristles to neighboring trailing ends or to a cover.

At least one bottom surface in the form can be provided with at least one hill and at least one valley so that, when a batch or tuft of bristles is introduced into the respective socket, some of the bristles are arrested or intercepted by the raised (hilly) portion and the other bristles are intercepted by the valleyed portion of the bottom surface to thus impart to the tufts in the finished product a predetermined shape (e.g., the tips of bristles in a toothbrush need not be located in a common plane but instead form a complex profile including hills and valleys. This can hold true for each tuft or for selected tufts of bristles in a finished brush. Staggering of those ends of bristles which penetrate into the deepmost portions of the respective sockets is desirable in connection with the making of many types of brushes including toothbrushes, paintbrushes and others.

The assembling unit of the improved apparatus can comprise at least two forms each of which has a plurality of sockets, and such apparatus can comprise conduits which define discrete paths for simultaneous delivery of bristles from the source to the sockets of several forms.

The conveying means can further comprise means for receiving bristles from the source, for gathering the thus received bristles into tufts containing different numbers of bristles, and for delivering the tufts to the sockets.

The source can comprise a plurality of magazines and means for simultaneously withdrawing tufts of bristles from the magazines. Such source can include a first and a second magazine, and the withdrawing means of the apparatus can comprise a transfer member which is disposed between the first and second magazines and has first and second sides adjacent the first and second magazines, respectively. Each side of the transfer member has at least one bristle-receiving pocket, and such apparatus can further comprise means for moving the transfer member between at least one first position in which the pockets receive bristles from the respective magazines and at least one second position in which the bristle-containing pockets are spaced apart from the magazines.

Each form can include a main section and a cover which overlaps and is separable from the main section. The sockets include portions (normally in the form of blind holes or bores) in the main section, and the cover has apertures which constitute the open ends of the sockets in assembled condition of the form. The cover of each form can be provided with a flange or lip which overlies and surrounds a recess of a brush body. Alternatively, the cover can be provided with a recess to receive a flange or another projection or protuberance of the brush body.

The cover for each form can be made of a material which is the material of a brush body so that the brush is completed when the bristles are welded or otherwise secured to the cover and the latter is separated from the main section of the respective form.

The conveying means can further comprise means for mechanically advancing predetermined numbers of bristles from the source to the sockets; such means for mechanically advancing can replace the aforediscussed conduits. The advancing means can include a transfer member and means for moving the transfer member between at least one first position in which the transfer member receives bristles from the source and at least one second position in which the thus received bristles are aligned with the sockets of a single form or with the sockets of two or more forms. Such apparatus can further comprise guide means having openings in register with the open ends of the sockets, at least in the at least one second position of the transfer member, and the guide means is then disposed between the open ends of the sockets and the transfer member in the at least one second position of the transfer member so that the drawing means can introduce bristles into the sockets through the openings of the guide means.

As mentioned above, each form can have at least one foraminous insert which is adjacent the respective sockets, and the drawing means of an apparatus employing such form or forms includes means for evacuating air from the sockets through the at least one insert.

The cover of a composite form can be provided with thermoplastic projections which are adjacent its apertures, and the enlarging means of such apparatus can include means for bonding (e.g., welding) the aforementioned portions of the bristles to the adjacent projections of the cover.

The source of bristles can comprise at least one magazine, and the apparatus can further comprise an indexible transfer member having bristle-receiving pockets and means for indexing the transfer member (preferably about a substantially vertical axis) between at least one first position in which at least some of the pockets receive bristles from the at least one magazine, and at least one second position in which the bristle-containing pockets are spaced apart from the at least one magazine. The source can contain a plurality of magazines and the pockets then preferably form sets of pockets (particularly two sets of pockets for each magazine). The transfer member is preferably indexible in a single direction between a plurality of first and second positions in each of which several pockets receive bristles from the plural magazines and several sets of pockets (which contain bristles) are spaced apart from the magazines.

The transfer member is or can be indexible through angles of approximately 90° if the source of bristles comprises two magazines which are disposed diametrically or substantially diametrically opposite each other with reference to the indexible transfer member.

The transfer member can include or constitute a rotary disc having a cylindrical or substantially cylindrical peripheral surface with axially parallel open recesses which constitute the aforementioned pockets.

The arrangement may be such that the bristle-containing pockets register with the sockets of at least one form in the at least one second position of the indexible transfer member, or that the conveying means further comprises conduits which establish paths for advancement of bristles from bristle-containing pockets of the indexible transfer member to the sockets of one or more forms in the at least one second position of the transfer member.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawing.

BRIEF DESCRIPTION OF THE DRAWING

FIG. 1*a* is a fragmentary sectional view of a modified form which does not embody a foraminous insert;

FIG. 1*b* is a fragmentary sectional view of another form wherein the effective length of the sockets can be varied by discrete pistons;

FIG. 2 is a plan view of a source of bristles which can be utilized in the apparatus of FIG. 1 and wherein a single transfer member serves to withdraw bristles from two discrete magazines;

FIG. 3 is a plan view of a form with an oval array of sockets for discrete bristles and/or tufts of bristles;

FIG. 5 is a fragmentary sectional view of a form with a modified cover and of four tufts which are not bonded to each other;

FIG. 6 is a view similar to that of FIG. 5 but showing a modified cover wherein the deformed end portions of bristles in neighboring sockets of the form are bonded to each other;

FIG. 7 is a plan view of the cover which is shown in FIG. 6;

FIG. 8 is a side elevational view of a brush body and a sectional view of a cover with a set of tufts and with a flange, or lip serving to overlie and seal a recess in the rush body;

FIG. 9 is a partly side elevational and partly sectional view of a toothbrush wherein the cover forms an integral part of the brush body, a plate-like lid being shown adjacent a recess in the rear side of the brush body behind the deformed end portions of bristles in the cover;

FIG. 10 is a fragmentary partly elevational and partly sectional view of a brush wherein the tufts of bristles are anchored, in the cover in a manner as shown in FIG. 6 and the tufts include shorter and longer tufts;

FIG. 11 is a view substantially as seen in the direction of arrows from the line XI—XI of FIG. 10;

FIG. 11*a* is a fragmentary sectional view of a form for the making of brushes of the type shown in FIG. 10;

FIG. 12 is an enlarged view of a tuft of the type shown in FIG. 11;

FIG. 13 is a plan view of a tuft;

DESCRIPTION OF PREFERRED EMBODIMENTS

Figure 1:
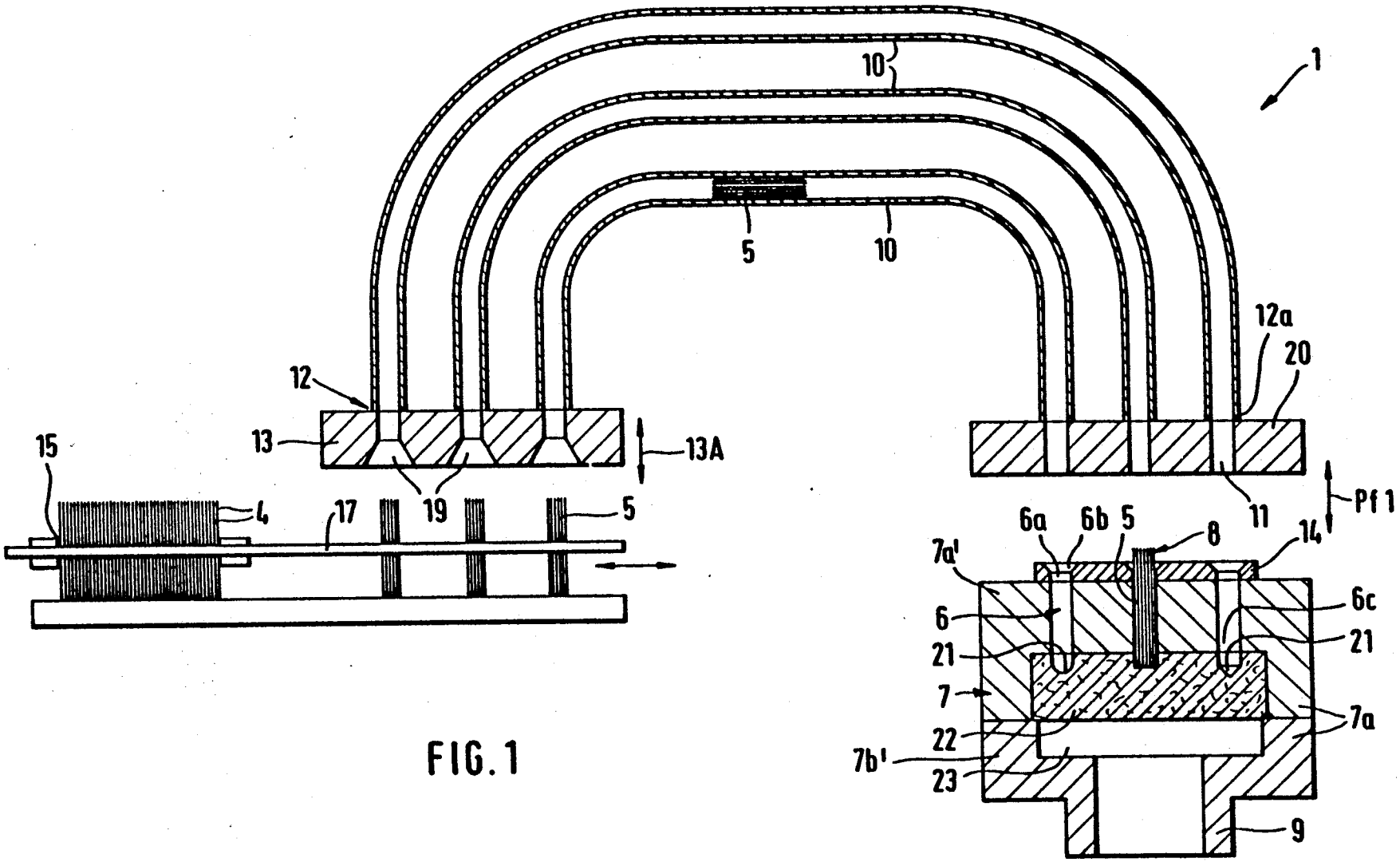
FIG. 1 is a schematic partly elevational and partly vertical sectional view of a first apparatus which embodies the invention and wherein the forms have foraminous inserts defining portions of sockets for discrete bristles or tufts of bristles.
Figure 4:
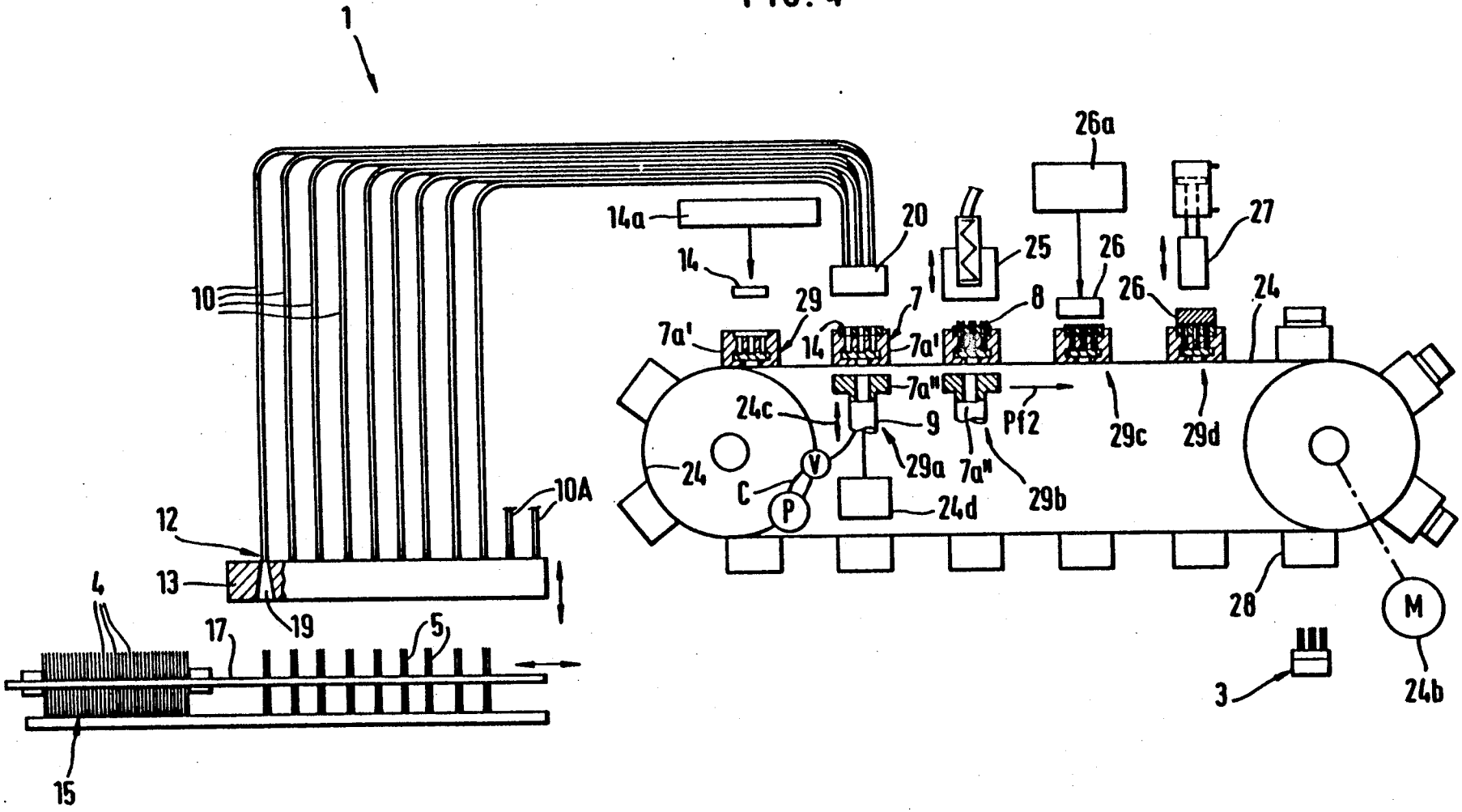
FIG. 4 is a partly elevational and partly vertical sectional view of a modified apparatus with a larger number of conduits between the source of bristles and the station where the bristles are introduced into the sockets of successive forms, and further showing the means for deforming the end portions of introduced bristles and the means for assembling inserted bristles and covers with brush bodies.

FIGS. 1, 2 and 4 show certain details of a brush making apparatus 1 which can be used to assemble arrays 2 (see, for example, FIGS. 8 and 9) of individual bristles 4 or tufts 5 of bristles 4 with brush bodies (such as the brush body 26 of FIG. 8) into finished articles in the form of toothbrushes (FIGS. 8 and 9), paintbrushes (including those to be used by artists and those used by house painters or other artisans) and/or other setaceous products. The making of brushes involves deforming (hereinafter simply called enlarging) one end of each bristle 4 into reliable engagement with one or more adjacent bristles and/or with the adjacent portion of a cover or adapter (shown at 14 in FIG. 1). If the brush contains tufts 5 of bristles 4 (rather than arrays of individual bristles), the anchored ends of bristles 4 in each tuft 5 can be welded, glued or otherwise reliably secured to other bristles of the respective tuft and/or to the bristles of one or more neighboring tufts and/or to the brush body. The presently preferred mode of enlarging the anchored end portions or ends 8 of bristles 4 is to heat thermoplastic bristles at least close to the melting point of their material and to thereupon deform as well as anchor the heated and softened ends 8 of bristles in the brush body.

The apparatus 1 comprises one or more forms 7 each of which includes a main section *7a* and a plate-like cover 14 which overlaps the respective main section *7a*. The form 7 has sockets 6 which, in turn, have blind bores or holes *6c* in the main section *7a* and open ends constituted by apertures *6a* in the cover 14. When a cover or adapter 14 is properly (but separably) connected or coupled to the respective main section *7a*, each of its apertures *6a* registers with the open end of a blind hole *6c* in the adjacent main section so that the thus formed composite socket 6 is ready to receive a discrete bristle 4 or a tuft 5 of two or more at least substantially parallel bristles 4. As can be seen in FIG. 1, which shows a single form 7 and a tuft 5 of bristles 4 in one of several sockets 6, the exposed end portions or ends 8 of the bristles 4 are located at the upwardly diverging portion *6b* of the respective aperture *6a*, namely at that end of the aperture which is remote from the main section *7a* of the form 7. The end portions 8 are thereupon welded to each other and/or to the adjacent portion of the cover 14 and/or to the end portions 8 of bristles 4 forming a tuft 5 (not shown) in one or more adjacent sockets 6. The end portions 8 which are to be enlarged (e.g., welded) can project slightly beyond the exposed upper side of the cover 14 or they can be confined in the enlarged portion *6b* of the respective aperture *6a*, depending upon the desired anchoring force and/or upon the nature of connection to be established between the bristles 4 and the cover 14.

The main section *7a* of each form 7 has an air evacuating portion 9 in the form of a nipple which is connected to a suction generating device (such as a vacuum pump P shown in FIG. *1a*) serving to evacuate air from a suction chamber 23 in the main section *7a*. The latter contains a foraminous insert 22 one side of which is adjacent the suction chamber 23 and another side of which is formed with relatively shallow recesses constituting the deepmost portions of the blind holes or bores *6c* in the main section *7a* of the form 7. Thus, the insert 22 defines the bottom surfaces 21 in the sockets 6, and the profiles of such bottom surfaces determine the axial positions of bristles 4 in the respective tufts 5. FIG. 1 shows, by way of example, that one of the sockets 6 can be bounded by a concave bottom surface 21, that another socket 6 can be bounded by a flat bottom surface 21, and that a third socket 6 can be bounded by a conical bottom surface 21. One or more bottom surfaces 21 can be inclined relative to the recessed side of the insert 22, and it is equally possible to provide the insert with convex, partly flat and partly concave and/or otherwise configurated bottom surfaces for the respective sockets 6. The profiles of all bottom surfaces 21 in an insert 22 may but need not be the same. Furthermore, the insert 22 can consist of two or more parts which are fitted together in the internal space of the main section *7a* to define the deepmost portions of the sockets 6 and to impart a desired shape to the adjacent end faces of tufts 5 in the respective sockets.

The means for conveying discrete bristles 4 or tufts 5 of bristles 4 from a source of such bristles toward and into the sockets 6 includes a plurality of conduits 10, one for each socket 6 of a single form 7 or one for each socket of two or more forms, depending upon the capacity of the brush making apparatus. Such conveying means further includes the suction chamber or chambers 23 and the nipple(s) 9 as well as the suction generating device P which cooperates with the suction chamber(s) and with the nipple(s) to draw discrete bristles 4 or tufts 5 of substantially parallel bristles by suction all the way from the source into the respective sockets 6. The inner diameter of each conduit 10 can be in the range of 0.1 to 20 mm, depending upon the diameters of discrete bristles 4 and upon the transverse dimensions of the tufts 5. As a rule, the inner diameter of a conduit 10 will slightly exceed the diameter of a discrete bristle or the diameter of a tuft which is to be drawn into the respective socket 6. The conduits 10 define at least substantially sealed paths for advancement of discrete bristles 4 and/or tufts 5 of bristles.

The discharge ends *12a* of the conduits 10 are affixed to or extend into a plate- or strip-shaped carrier or support 20 which is movable relative to the form 7 (and/or vice versa) in directions indicated by a double-headed arrow Pf1. The support 20 has passages 11 (e.g., in the form of cylindrical bores or holes) which register with the discharge ends *12a* of the conduits 10 and with the open ends *6b* of the sockets 6 in a form 7 which is ready to receive a predetermined number of bristles 4 in the form of tufts 5 and/or individual bristles, depending upon the nature of the ultimate product.

The movability of the support 20 and form 7 relative to each other need not be only in the axial direction (arrow Pf1) of the sockets 6 but also in one or more other directions. For example, the support 20 can be mounted for movement in directions which are indicated by the double-headed arrow Pf1, and the form or forms 7 can be mounted for movement in the direction of arrow Pf2 shown in FIG. 4.

The apparatus 1 can be furnished with two or more different supports 20, one for each of two or more different arrays 2 of tufts 5 in a brush 3 which is to be produced in the improved apparatus 1. Thus, the discharge ends *12a* of the conduits 10 can be detached from the illustrated support 20 to be separably connectable with at least one additional support having a different distribution of passages 11, depending on the distribution of sockets 6 in a form 7 which is to receive bristles 4 through the passages of the support which is to replace the support 20 of FIG. 1. At least the discharge ends 12*a* of the conduits 10 are flexible to permit a desired distribution of such discharge ends, depending upon the distribution of passages 11 in a selected support 20. For example, a portion of each conduit 10, or each of these conduits, can constitute a flexible hole which can be made (at least in part) of light-transmitting material to permit convenient observation of advancement of bristles 4 or tufts 5 of bristles from the source toward and into the respective sockets 6.

The bristle-receiving ends 12 of the conduits 10 are separably or permanently connected to a plate- or strip-shaped carrier or support 13 which has passages 19 for admission of bristles or tufts of bristles into the respective conduits. The passages 19 have downwardly diverging frustoconical portions which facilitate penetration of discrete bristles or tufts of bristles into the respective conduits 10. The distribution of passages 19 in the carrier 13 may but need not be the same as the distribution of passages 11 in the support 20. The carrier 13 is movable in directions which are indicated by a double-headed arrow 13A, e.g., by a fluid-operated (pneumatic or hydraulic) motor, not shown.

The bristle-receiving ends 12 of the conduits 10 are or can be separably secured to the carrier 13, depending upon whether the apparatus 1 is furnished with a single carrier or with two or more carriers. If the distribution of receiving ends 12 is to be changed, those portions of the conduits 10 which include the receiving ends 12 are made of a flexible material. Alternatively, and as already mentioned above, each conduit 10 can constitute a flexible hose.

It goes without saying that the support 20 is at least closely adjacent but preferably sealingly engages the exposed side of the cover 14 to prevent the flow of excessive quantities of atmospheric air between the parts 14, 20 and into the sockets 6 when the suction generating device P is on to draw bristles 4 from the receiving ends 12 of the conduits 10 into and beyond the respective discharge ends 12*a*, i.e., into the registering sockets 6 of the form 7 which abuts or is adjacent the support 20.

The source of bristles 4 can comprise one or more magazines 15 each of which can receive and confine a rather large supply of preferably parallel and preferably vertical or nearly vertical bristles. FIG. 2 shows a source with two mirror symmetrical magazines 15 and a transfer member 17 between the two magazines. Magazines which can be used in the apparatus of the present invention are described, for example, in U.S. Pats. Nos. 4,647,113, 4,610,481 and 4,904,025 to which reference may be had, if necessary.

The transfer member 17 has two parallel sides 16 which close the adjacent openings of the magazines 15 and are provided with groups of pockets 18 for reception of individual bristles 4 or of tufts 5 of bristles from the respective magazines 15. To this end, the supplies of bristles 4 in the magazines 15 are urged against the respective sides 16 of the transfer member 17 by pushers 15*a* acting in directions which are indicated by arrows Pf3. A motor 17*a* (e.g., a double-acting cylinder and piston unit) is provided to move the transfer member 17 between at least one first position in which one or more pockets 18 in the right-hand side 16 of the transfer member can receive bristles 4 from the right-hand magazine 15 of FIG. 2 and one or more pockets 18 in the left-hand side 16 of the transfer member 17 can receive bristles 4 from the left-hand magazine 15, and at least one second position in which the bristle-containing (filled) pockets 18 are spaced apart from the magazines 15 to assume positions in which their contents can enter the adjacent receiving ends 12 of the conduits 10 for advancement into the corresponding sockets 6. The directions in which the transfer member 17 is movable (preferably reciprocable) between its first and second positions are indicated by a double-headed arrow 17A.

The source which is shown in FIG. 2 further comprises two walls 18*a* which are pressed against the adjacent sides 16 of the transfer member 17 by double-acting cylinder and piston units 18*b* or by other suitable biasing means which enable the walls 18*a* to prevent escape of bristles 4 and/or tufts 5 from the pockets 18 during transfer of such bristles or tufts from the respective magazines 15 to positions of alignment with the respective receiving ends 12.

The pockets 18 in the right-hand side 16 of the transfer member 17 of FIG. 2 may but need not be identical with the pockets 18 in the left-hand side 16. Furthermore, the one and/or the other side 16 of the transfer member 17 can be provided with differently configurated pockets 18 which can receive different numbers and different arrays of bristles 4. This can be readily seen in FIG. 2 wherein each of the two sides 16 is formed with larger and smaller pockets 18. FIG. 1 shows the transfer member 17 in the second position in which some of its pockets 18 maintain tufts 5 of bristles 4 a predetermined distribution, namely in positions of register with the adjacent receiving ends 12 of the respective conduits 10. One of the magazines 15 can be emptied if the pockets 18 in one side 16 of the transfer member 17 suffice to supply tufts 5 to the receiving ends 12 of all conduits 10 which are to advance such tufts into the registering sockets 6 of the form 7 which is then adjacent the support 20.

If the apparatus 1 is set up for the making of a single type of brushes 3, the conduits 10 can be made of a metallic or rigid plastic material because it is not necessary to change the distribution of the receiving ends 12 and/or discharge ends 12*a*. The utilization of a carrier 13 with downwardly diverging frustoconical or partly frustoconical passages 19 is particularly desirable if the conduits 10 are to receive tufts 5 of parallel bristles 4; the surfaces surrounding such passages 19 facilitate unimpeded or practically unimpeded entry of all bristles 4 of each tuft 5 into the respective conduit 10.

The provision of bottom surfaces 21 having a predetermined profile is particularly advantageous when the exposed ends of the tufts 5 in a finished brush 3 (the exposed ends are those ends which are received in the recesses of the insert 21 upon completed conveying of tufts from the transfer member 17 into the respective sockets 6) are to exhibit a particular shape (e.g., a conical shape, a hemispherical shape or a more complex shape). Thus, it is not necessary to trim the tips of tufts 5 in a finished brush 3 because the tips of such tufts can be imparted a particular profile as a result of conveying them by suction into the sockets 6 and into abutment with the respective bottom surfaces 21 in the recesses of the insert 22.

FIG. 1*a* shows a modified form 107 which need not contain or comprise a foraminous insert because its sockets 106 communicate with the suction chamber 123 by way of suction ports or channels 123*a*. The intake ends of the channels 123*a* extend substantially radially and laterally of the respective sockets 106, and the discharge ends of these channels communicate with the suction chamber 123. The latter is connected with the suction generating device P by a nipple 109 and/or in any other suitable way. A conduit C between the nipple 109 and the suction generating device P contains a shut-off valve V. The form 107 of FIG. 1*a* can also include a main section and a cover 114 which latter has apertures constituting the open ends of the sockets 106. Each of these sockets can be communicatively connected with the suction chamber 123 by two or more channels or ports 123*a*. The positions of intake ends of the channels 123*a* are selected with a view to ensure that each bristle in each of the sockets 106 actually reaches and abuts the bottom surface 121. It is further possible to connect the discharge ends of two or more channels 123*a* with a larger channel or bore which serves to convey evacuated air into the suction chamber 123.

The insert 22 of FIG. 1 can be made of a sintered metallic or ceramic material which exhibits a required porosity to permit predictable evacuation of air from the sockets 6 when the suction generating device P is on to draw discrete bristles 4 or tufts 5 of bristles 4 toward and into abutment with the bottom surfaces 21 in the respective sockets 6. The insert 22 can also be made of a textile material (e.g., felt) or any other material which exhibits satisfactory permeability for the purpose of enabling the suction generating device P to draw tufts of bristles 4 all the way from the transfer member 17 (via conduits 10) and into the sockets 6. An advantage of a form 7 with a foraminous insert 22 over a form 107 of the type shown in FIG. 1*a* is that the leading ends of bristles 4 are more likely to advance all the way into abutment with the respective bottom surfaces 21. On the other hand, the form 107 exhibits the advantage that the channels 123*a* in its main section are less likely to be rapidly clogged than the pores of the insert 22.

The insert 22 can be replaced with a simple filter or screen having interstices which are sufficiently large to permit rapid evacuation of air from the sockets 6 but still enable the filter or screen to invariably intercept the front ends of bristles 4, i.e., the bottom surfaces 21 of the insert or filter must invariably intercept the bristles 4 in desired axial positions in which the tips of tufts 5 in the sockets 6 exhibit a desired (conical, hemispherical, flat or a more complex) configuration.

FIG. 10 shows that the distribution and/or length of bristles 4 in each tuft 5 of a finished brush 3 (e.g., a toothbrush) need not be the same. Thus, each tuft 5 can consist of shorter and longer bristles 4, and the dimensions of some or all of the tufts 5 in a brush 3 can be different. More specifically, FIG. 10 shows that certain tufts 5 can have substantially hemispherical tips (i.e., free ends bounded by substantially convex surfaces) and that certain other tufts 5 can have tips with alternating hills and valleys.

FIG. 11 shows that all of the tufts 5 are identical but that each of these tufts consists of shorter and longer bristles 4. Brushes 3 of the type shown in FIGS. 10 and 11 are preferred for numerous applications because the cleaning effect of their bristles 4 is more satisfactory if the effective length of all bristles in a tuft 5 and/or of all bristles in the brush is not the same. The configurations of the free ends or tips of tufts 5 which are shown in FIGS. 10 and 11 can be arrived at by the simple expedient of properly selecting the profiles of bottom surfaces 21 in the sockets 6 of the form 7 or 107 in which bristles are assembled to form tufts of the type shown in FIGS. 10 and 11. FIG. 11*a* shows a portion of a form 7 with a socket 6 wherein the bottom surface 21 has a set of alternating hills and valleys for the purpose of assembling tufts 5 of the type shown in FIG. 11. A single tuft 5 of the type shown in FIG. 11 is shown on a larger scale in FIG. 12. FIG. 13 shows that a tuft 5 can constitute a cylinder consisting of at least substantially parallel bristles 4. The tuft 5 of FIG. 13 can have concentric annuli of bristles 4 wherein annuli of shorter bristles alternate with annuli of longer bristles. Alternatively, the tuft 5 of FIG. 13 can resemble the leftmost or the rightmost tuft 5 in the brush 3 of FIG. 10, i.e., the effective length of the centrally located bristles 4 exceeds the effective length of outer bristles and the effective length of the bristles can decrease from the center toward the periphery of the tuft 5 so that the tip of the tuft resembles a hemisphere or a cone.

FIG. 1*b* shows a further form 207 wherein the effective depth of the sockets 206 can be varied by a set of discrete pistons 206*d* connected to a main piston 206*e* which is reciprocable between the chambers 206*f*, 206*g* of a double-acting fluid-operated cylinder 206*h*. A projection or stop 206*i* in the chamber 206*g* limits the extent of movability of pistons 206*d* in the respective cylinder chambers or holes 206*j* of the form 207 in a direction away from the open ends of the corresponding sockets 206. The form 207 is further provided with channels 223*a* which perform the functions of channels 123*a* shown in FIG. 1*a* and are connected to a suction chamber, not shown in FIG. 1*b*. The pistons 206*d* define the bottom surfaces 221 in the respective sockets 206. FIG. 1*b* shows concave bottom surfaces 221; however, it is equally possible to provide some or all of the pistons 206*d* with flat, convex, undulate and/or otherwise profiled bottom surfaces.

The main piston or plunger 206*e* is moved in synchronism with the operation of certain other parts of the apparatus which embodies the form 207 of FIG. 1*b*. Thus, the pistons 206*d* can be retracted to their deepmost or rearmost positions (in which the main piston 206*e* abuts the projection or stop 206*i*) during drawing of bristles into the sockets 206 as a result of evacuation of air via channels 223*a*. The pistons 206*d* are thereupon caused to move to extended positions (to reduce the effective length or depth of the respective sockets 206) preparatory to enlargement of the outer or exposed end portions of the bristles in the thus shortened sockets 206.

The main piston 206*e* can be omitted if the channels 223*a* are used to lift the pistons 206*d* and if such channels can also receive compressed air to push the respective pistons 206*e* back to their innermost or rearmost positions.

An advantage of the form 207 is that it even more reliably ensures that the bristles of each tuft assume predetermined axial positions prior to welding of their exposed ends to each other, to the bristles of the neighboring tufts and/or to the cover of a composite form. This is due to the fact that, if one or more bristles happen to lag behind the others (i.e., if all of the bristles do not abut the respective bottom surfaces 221 when the step of evacuating air from the sockets 206 is completed), the pistons 206*e* compensate for such failure of certain bristles to abut the bottom surfaces 221 by moving toward the open ends of the sockets 206 in order to move the bottom surfaces 221 against or nearer to the lagging bristles. Such lagging of certain bristles during evacuation of air from the sockets 206 is more likely to occur if the means for drawing air from the sockets 206 includes channels 223a in lieu of one or more foraminous inserts 22.

As can be seen in FIG. 3, a form 7, 107 or 207 (FIG. 3 shows a form 7) can be provided with a large number (fourteen) of sockets 6, and the cross-sectional areas of all of the sockets need not be the same. The leftmost socket 6 of FIG. 3 has a polygonal (e.g., square) cross-sectional outline, each of the two rightmost sockets 6 has a substantially oval cross-sectional outline, and each of the remaining sockets 6 has a substantially circular cross-sectional outline. Furthermore, the additional (circular) sockets 6 include larger-diameter and smaller-diameter sockets. The distribution of sockets in a form can depart considerably from that which is shown in FIG. 3; for example, the sockets can form a substantially rectangular or square or circular array (instead of the substantially oval array which is shown in FIG. 3).

One of the magazines 15 which are shown in FIG. 2 can contain relatively thick bristles 4 and the other magazine 15 can contain thinner bristles. Thus, the array 2 which is to be assembled in the form 7 of FIG. 3 can include a certain number of tufts consisting of thicker bristles and a certain number of tufts consisting of thinner bristles. Furthermore, certain sockets 6 of FIG. 3 can receive (relatively thick) discrete bristles and certain sockets can receive tufts of (relatively thin and/or relatively thick) bristles. Still further, one of the magazines 15 which are shown in FIG. 2 can comprise bristles of a first color and/or made of a first thermoplastic material, and the other magazine 15 can contain bristles of a second color and/or made of a different second thermoplastic material. For example, the bristles in one of the magazines 15 are readily flexible and the bristles in the other magazine are stiffer. Such selection of bristles in the source of bristles renders it possible to mass-produce brushes with bristles and tufts of bristles and arrays of tufts which exhibit any desired characteristics as concerns the color, flexibility, quality, diameter and/or other parameters.

The dimensions of tufts will depend upon the dimensions of corresponding pockets 18 in the transfer member 17. However, the pockets 18 can be formed in such a way that their dimensions merely determine the numbers of bristles which are to be drawn through the respective conduits 10; the cross-sectional outlines of the tufts 5 are then determined by the cross-sectional outlines of sockets in the respective form or forms 7, 107 or 207. It normally suffices to properly select the cross-sectional outlines of apertures 6a in the covers 14, i.e., and since the end portions 8 of the bristles 4 forming the tuft 5 in the median socket 6 of FIG. 1 are not permitted to enter the respective blind hole 6c, the blind hole 6a can be a cylindrical hole even if the tuft 5 is to have an oval or polygonal cross-sectional outline because such cross-sectional outline of the tuft is determined by the respective aperture 6a of the cover 14. All that counts is to ensure that each bristle 4 of a tuft 5 which is to be assembled in a selected socket 6 can partially penetrate into the corresponding blind hole 6c so that all bristles contact the respective bottom surface 21.

The distribution of pockets 18 in one or both sides 16 of the transfer member 17 can depart from the distribution which is shown in FIG. 2. For example, the sides 16 need not be flat (i.e., the pockets 18 in such sides need not form straight rows) if the walls 18 (or those portions of the walls 18a which are adjacent the respective sides 16 of the transfer member 17) are made of an elastomeric material which can be deformed (by the cylinder-and-piston units 18b or in any other way) into sealing engagement with concave, convex and/or otherwise configurated sides of the member 17.

The maximum number of pockets 18 in each of the sides 16 can also depart from the numbers which are shown in FIG. 12. Moreover, the number of pockets 18 in one of the sides 16 can be a small or a large fraction of the number of pockets in the other side 16.

By way of example, and if the apparatus is to cyclically produce sets of four brushes 3 at a time, the source of bristles can contain four magazines 15 with one transfer member 17 for each pair of magazines, and each such transfer member is then provided with a number of pockets corresponding to the combined number of sockets in two forms 7, 107 or 207. It is also possible to employ a discrete transfer member for each magazine, or to employ a first transfer member in a manner as shown in FIG. 2 (i.e., for withdrawal of bristles from two neighboring magazines) and one or more additional transfer members each of which serves to draw bristles from a single magazine.

As already mentioned above, the inner diameters of the conduits 10 can be within the range of 0.1 to 20 mm. It is presently preferred to employ conduits with inner diameters in the range of 1 to 10 mm, most preferably in the range of 2 to 5 mm. The length of the conduits 10 is normally within the range of 1 to 10 meters, for example, approximately 5 meters. Conduits having the aforementioned inner diameters and a length of 1 to 10 meters have been found to permit predictable advancement of discrete bristles or tufts of bristles from the source and all the way into contact with the bottom surfaces 23, 123 or 223 in the respective sockets 7, 107 or 207. The exact length of the conduits 10 will depend upon the dimensions of the space which is available for installation of the improved brush making apparatus and/or upon certain other considerations. The conveying means of the improved apparatus can include shorter, medium long and longer conduits (this can be seen in FIGS. 1 and 4).

FIG. 4 shows that the number of conduits 10 in an apparatus 1 can exceed the number of sockets 6 in a form 7. For example, each of the set of forms 7 which are shown in FIG. 4 can have nine suitably distributed or arrayed sockets 6. On the other hand, the number of conduits can equal n times m wherein m is the number of sockets 6 in a form 7 and n is a whole number including two or more. Two additional conduits are shown in FIG. 4 at 10A; these conduits form part of at least one set of nine conduits which are provided in addition to the conduits 10 and serve to convey discrete bristles and/or tufts of bristles from the source (for example, a source comprising one or more magazines 15 of the type shown in FIG. 2) to a second form 7 behind the form at a bristle- or tuft-admitting station 29a of FIG. 4.

The number of conduits will depend on the desired output of the brush making apparatus and on the number of sockets in a discrete form 7, 107 or 207.

FIG. 4 further shows that the apparatus 1 can comprise means for transporting one or more groups of successive forms 7 and main sections 7a along a predetermined (preferably endless) path. The illustrated transporting means comprises an endless belt or chain conveyor 24 which is trained over pulleys or sprocket wheels 24a to advance the preferably equidistant forms 7 and main portions 7a of forms 7 in the direction of arrow Pf2. The forms 7 and main sections 7a are advanced stepwise by a suitable prime mover 24b. The introduction of bristles and/or tufts of bristles takes place into successive forms 7 which reach the admitting station 29*a* adjacent the substantially horizontal upper reach or stretch of the conveyor 24, and the expulsion of bristles and tufts of bristles of finished brushes 3 from the blind holes 6*c* of the respective main sections 7*a* takes place at a station 28 which is adjacent the lower reach or stretch of the conveyor 24.

A main section 7*a* is temporarily (detachably) coupled with a cover 14 at a station 29 which is located upstream of the station 29*a*. Covers 14 are supplied by a source 14*a*, and the means for transferring covers from the source 14*a* to successive main sections 7*a* which reach the station 29 can include tongs, a chute for gravity feed of covers or any other suitable cover delivering means.

The station 29*a*, at which successive fully assembled forms 7 (each including a main section 7*a* which is overlapped by a cover 14) receive arrays 2 of bristles 4 and/or tufts 5, is followed by a station 29*b* wherein the exposed ends 8 of the bristles 4 extending into the respective sockets 6 are enlarged by a reciprocable or otherwise movable heating device 25 serving to heat the end portions 8 at least close to the melting point of the material of the bristles 4 and to force the thus softened end portions 8 into the respective apertures 6*a* so that the softened end portions are bonded to the corresponding cover 14, to the other bristles 4 of a tuft 5 and/or to the end portions 8 of bristles 4 in one or more neighboring apertures 6*a*. All that counts is to ensure that the end portions 8 are properly bonded (e.g., welded) to the respective cover 14 because the latter constitutes or can constitute a component part of the respective brush 3. It is also possible to reliably secure the end portions 8 to the respective covers 14 by the simple expedient of mechanically deforming the end portions 8 and/or by spraying an adhesive onto the end portions 8 prior to deformation of such end portions into engagement with neighboring end portions 8 and/or into engagement with the cover 14.

The station 29*b* is followed by a station 29*c* where the covers 14 (each of which is already connected with the corresponding array 2 of bristles 4 and/or tufts 5) are overlapped by brush bodies 26 (actually by main portions of brush bodies) which are drawn from a suitable source 26*a*, e.g., in the same way as described for withdrawal of covers 14 from the respective source 14*a* at the station 29. The brush bodies 26 are permanently or detachably affixed to the respective covers 14 at a treating station 29*d* which accommodates a reciprocable affixing or treating device 27, e.g., an ultrasonic welding device or an adhesive applicator coupled with a ram or a like part capable of urging the brush bodies 26 against the respective covers 14. This completes the making of a brush 3, and such brush is thereupon advanced to the station 28 where its bristles are expelled from the blind bores 6*c* of the respective main section 7*a*, e.g., by admitting compressed air into the corresponding suction chamber 23 and/or by exerting a pull upon the corresponding brush body 26 in a direction to extract the bristles from their blind holes 6*c*. The descending brushes 3 can be intercepted by a take-off conveyor (not shown) or gathered in a suitable receptacle, not shown. The main sections 7*a* advance beyond the station 28 toward the station 29 where they are temporarily coupled with freshly supplied covers 14.

The covers 14 can be made of the same material as the brush bodies 26. This simplifies permanent bonding of covers (and arrays 2 of bristles and/or tufts) to the respective brush bodies. For example, the covers 14 and the brush bodies 26 can be made of a suitable synthetic thermoplastic material which is heated at the station 29*d* to a temperature necessary to ensure predictable and reliable bonding of each cover to the respective brush body. If the covers 14 are to be adhesively secured to brush bodies 26, the materials of these parts will be selected with a view to ensure the establishment of a reliable bond between each cover and the respective brush body. The exposed ends or tips of bristles 4 forming part of a finished brush 3 are those ends which were maintained in abutment with the respective bottom surfaces 23, 123 or 223 preparatory to and during enlargement of the other end portions 8 and during transport of forms toward the evacuating or expelling station 28.

FIG. 8 shows a brush body 26 and a slightly modified cover 114 immediately or shortly prior to arrival of the corresponding form 7 at the station 29*d* of FIG. 4, and FIG. 10 shows a portion of a finished brush 3, i.e., the cover 14 is already received in a complementary recess or depression 31 of the brush body 26. The enlarged end portions 8 of the bristles 4 are fully concealed by the parts 14 and 26.

Referring again to FIG. 8, the modified cover 114 has a flange or collar 30 which overlies the adjacent side of the brush body 26 when the major portion of the cover 114 is received in the recess 31 of the brush body. The flange or collar 30 is or can be a circumferentially complete frame which surrounds the array 2 of tufts 5 and surrounds the entire recess 30 when the assembly of the cover 114 with the brush body 26 is completed. An advantage of the flange or collar 30 is that it can prolong the useful life of a brush (such as the toothbrush 3 of FIG. 8) because it greatly reduces the likelihood of penetration of water and/or toothpaste and/or fragments of food into the recess 31.

FIG. 4 further shows that it is not necessary to transport complete main sections 7*a* toward and beyond the bristle- or tuft-admitting station 29*a*. Thus, it suffices to connect the conveyor 24 with the components 7*a*′ (FIG. 1) of the main sections 7*a* and to employ a single component 7*a*″ which is movable up and down (arrow 24*c* in FIG. 4) into and from sealing engagement with the component 7*a*′ which has arrived at the station 29*a*. This simplifies the apparatus because it is only necessary to provide a single conduit C and a single valve V. The means for moving the component 7*a*″ at the station 29*a* comprises a fluid-operated cylinder and piston assembly 24*d* or any other suitable reciprocating means. At least a portion of the conduit C can constitute a flexible hose to permit movements of the single component 7*a*″ into and from sealing engagement with the component 7*a*′ at the station 29*a*.

FIG. 5 shows that the adapter or cover 14 need not always be provided with apertures 6*a* having diverging portions (shown at 6*b* in FIG. 1) which are remote from the main section 7*a* of the form 7. FIG. 5 further shows that the end portions 8 of the bristles 4 can remain outside of the respective apertures 6*a* when the heating step is completed. On the other hand, the end portions 8 of bristles 4 which are shown in FIG. 6 are confined in the enlarged (diverging) portions 6*b* of the respective apertures 6*a*, and the end portions 8 of bristles in neighboring apertures 6*a* actually contact and are bonded to (melted into) each other to further enhance the stability of connection between the tufts 5 and the cover 14. The enlarged portions 6b of neighboring apertures 6a in the cover 14 of FIG. 6 communicate with each other at that side of the cover which faces away from the main section 7a. This is even more clearly shown in FIG. 7 wherein the end portion 6a of each aperture 6a communicates with at least two neighboring end portions 6a. This renders it possible to bond several bristles of each tuft to several bristles of the tufts in neighboring sockets 6 of the form utilizing the cover 14 of FIG. 7. The heating device 25 can readily deform the softened end portions 8 of the bristles 4 so that the deformed end portions 8 impart to the respective ends of the tufts a shape corresponding to that which is shown in FIG. 6, i.e., the deformed and enlarged end portions 8 at least partially fill the respective apertures 6a and several bristles of each tuft are bonded to the bristles of two or more neighboring tufts. In addition, the bristles of each tuft are bonded to each other and to the cover 14.

The arrangement may be such that the deforming action upon the softened end portions 8 of the bristles 4 is completed exclusively by the heating device 25 of FIG. 4 (FIG. 6), exclusively by the affixing device 27 (FIG. 10), or in part by the device 25 and in part by the device 27. Alternatively, and if the apparatus of FIG. 4 further comprises a component 7a'' at the station 29b, the softened end portions 8 of the bristles 4 (such softened end portions can have a doughy consistency) can be drawn into the respective enlarged portions 6b by suction to set during advancement of the respective components 7a' toward and past the station 29c. This ensures reliable bonding of the enlarged and deformed end portions 8a of bristles in each tuft to each other as well as (if desired) to the end portions 8 of bristles in neighboring tufts (FIGS. 6 and 7) and to the respective covers 14 or 114. Such drawing of the material of softened end portions 8 deeper into the respective apertures 6a enlarges the bonds between neighboring bristles of each tuft and thereby further ensures the establishment of a large-area bond between the end portion of each tuft and the surface bounding the respective aperture 6a of the cover 14 or 114.

Figure 14:
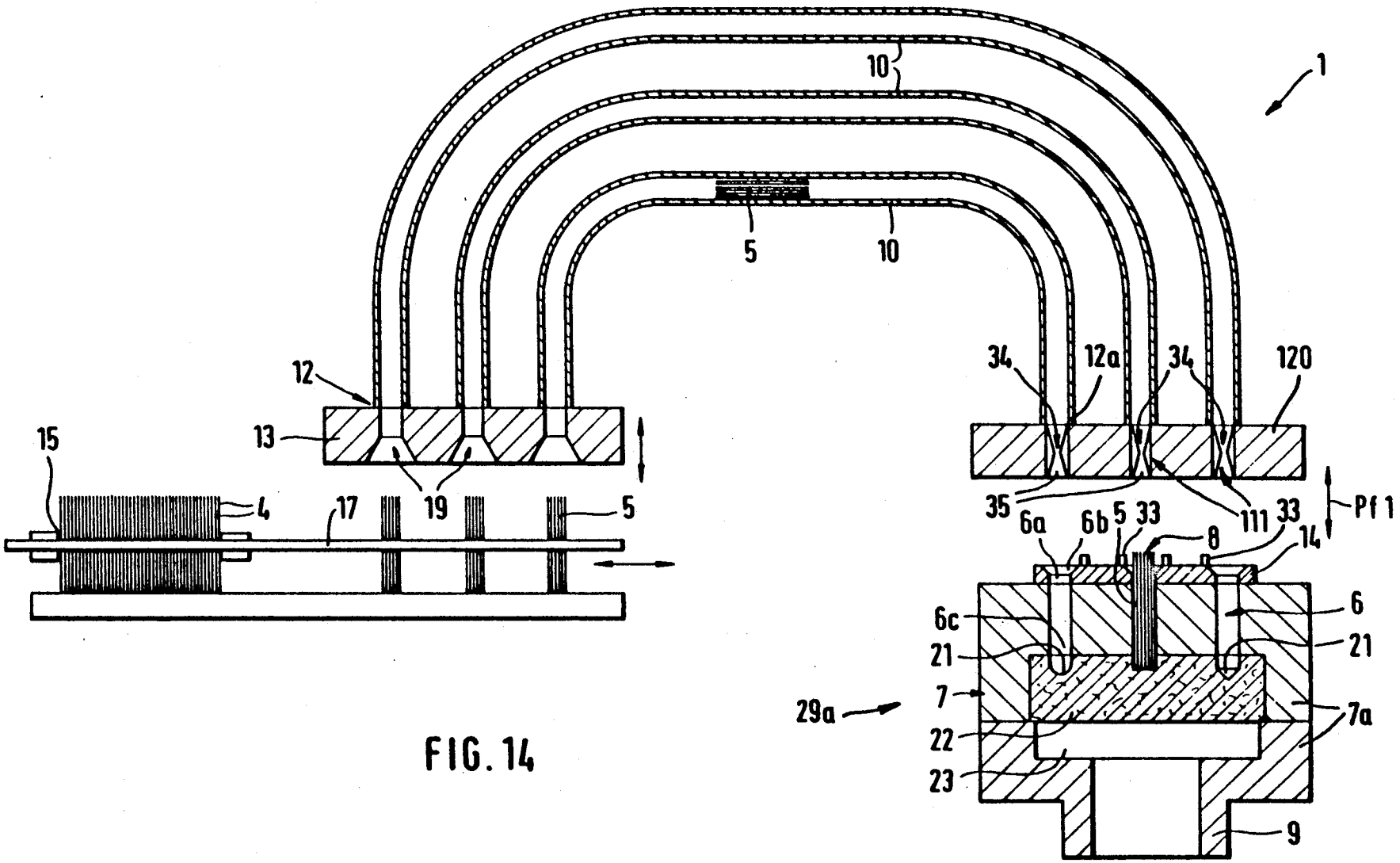
FIG. 14 is a partly elevational and partly vertical sectional view of an apparatus which constitutes a further modification of the apparatus of FIG. 1 and wherein the support for the discharge ends of bristle-conveying conduits is provided with flow restrictors serving to accelerate bristles on their way into the registering sockets.
Figure 15:
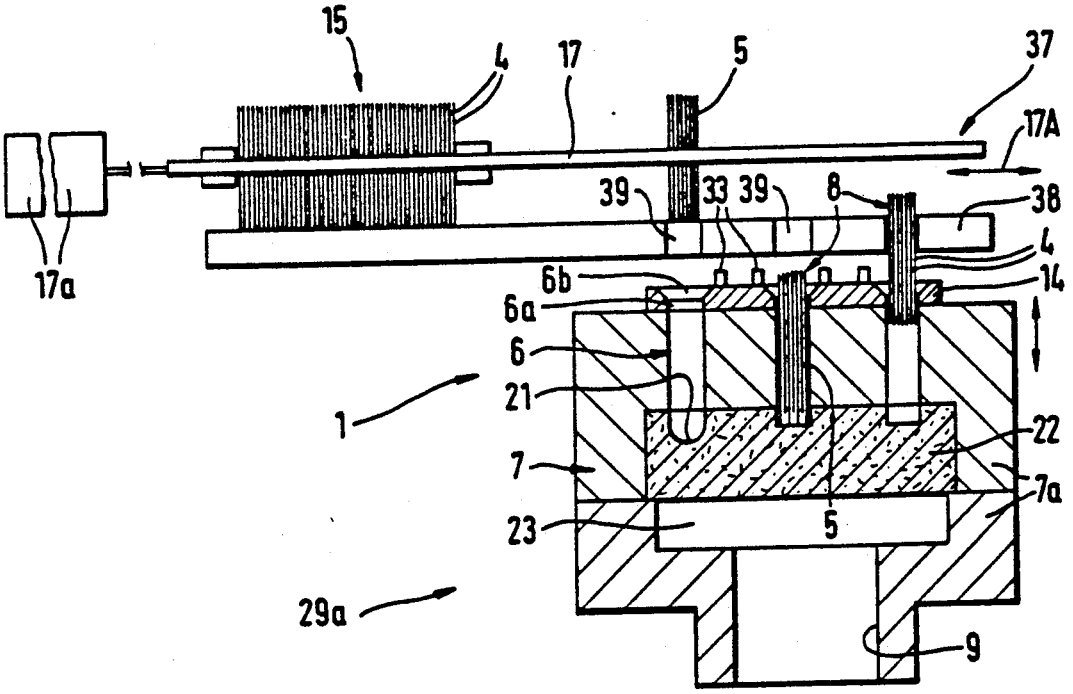
FIG. 15 is a partly elevational and partly vertical sectional view of a further apparatus wherein bristles and/or tufts of bristles are mechanically conveyed from the source of bristles to positions of alignment with the sockets of a form.

FIGS. 14 and 15 show that the covers 14 can be provided with projections or protuberances 33 at those sides which face away from the respective main sections 7a. These covers (or at least their projections 33) are made of a thermoplastic material so that the protuberances are softened and deformed as a result of heating at the station 29b of FIG. 4. This ensures that the softened projections 33 are reliably bonded to the adjacent softened end portions 8 of the bristles 4, i.e., the areas of bonds between the bristles 4 and the cover 14 are enlarged to further reduce the likelihood of accidental extraction of bristles from the body of a finished brush. The projections 33 can have a circular, oval or polygonal outline and each aperture 6a of the cover 14 can be surrounded by an annulus of discrete projections or by a circumferentially complete projection. The material of the covers 14 which are shown in FIGS. 14 and 15 can be the same as the material of the bristles 4; this renders it even more likely that the softened projections 33 will be reliably bonded to the end portions 8 of the adjacent bristles 4. However, it is equally within the purview of the invention to make the covers 14 of FIGS. 14 and 15 of a material other than the material of the bristles 4, as long as the softened end portions 8 of the bristles can be reliably bonded to the softened projections 33.

Referring to FIG. 7, the projections 33 can be distributed on the cover 14 in such a way that they fill the spaces 6b' between the communicating enlarged portions 6b of the apertures 6a so that the deformed end portions 8 of bristles in such apertures and the deformed projections of the cover 14 form a practically uninterrupted layer of hardened thermoplastic material to even further reduce the likelihood of extraction of bristles from the body of the finished brush. Portions of softened projections 33 can be caused to flow into the adjacent apertures 6a to even further reduce the likelihood of accidental extraction of bristles 4 and/or the likelihood of penetration of germs, toothpaste, fragments of food and/or water between a cover 14 and the corresponding brush body 26 if the ultimate product is a toothbrush.

FIG. 9 shows that the body 26 of a brush 3 can include an integral portion which forms a cover 214. This renders it possible to replace the source 14a of FIG. 4 with the source 26a. Moreover, it is then possible to dispense with the affixing device 27 of FIG. 4 because the making of brushes 3 is completed at the station 29b. FIG. 9 further shows a plate-like lid 32 which can be inserted into a recess 26b of the brush body 26 to conceal the enlarged (deformed) end portions 8 of bristles in the tufts forming the array 2. The lid 32 can be a press fit in the recess 26b or such lid can be bonded (e.g., adhesively or by welding) to the brush body 26. The provision of a lid 32 is particularly desirable if the bristles of each tuft are connected only to each other and/or to the cover 214 but not to the end portions 8 of bristles in the adjacent tufts (see FIG. 5).

The operation of the improved apparatus can be automated to any desired extent. Furthermore, the output of the apparatus can be increases still further if the conveyor 24 is driven continuously rather than intermittently; it is then necessary to provide means for moving the heating device 25 and the affixing device 27 through a certain distance in and counter to the direction of arrow Pf2 so that the device 25 shares the movement of the adjacent form 7 during heating of end portions 8 of the bristles 4 and that the affixing device 27 shares the movements of a component 7a', a cover 14 and a brush body 26 in the direction of arrow Pf2 while the body 26 is being secured to the adjacent cover 14. Irrespective of the nature of drive means for the conveyor 24 (i.e., regardless of whether the conveyor 24 is driven continuously or stepwise), the end portions 8 of bristles 4 which were inserted at the station 29a are being heated at the station 29b while the sockets 6 at the station 29a are in the process of receiving discrete bristles or tufts of bristles via conduits 10.

The output of the improved brush making apparatus considerably exceeds the output of a conventional apparatus wherein tufts of bristles are individually inserted into the sockets of a brush body. Moreover, anchoring of tufts 5 in the brush bodies is more uniform than in accordance with heretofore known procedures because the operation of the improved conveying means (including means for drawing bristles into the sockets 6 by suction P) is much more predictable and more uniform than conventional mechanical insertion of discrete tufts. Insertion of a large number of tufts into the sockets of a form by suction takes up less time than the insertion of a single tuft in accordance with heretofore known proposals. In addition, the improved apparatus renders it possible to rapidly shift from operation with identical bristles to operation with differently dimensioned and- /or colored bristles as well as to impart to the exposed tips of tufts 5 any desired shape which is best suited for a particular purpose, e.g., for a toothbrush, for a paintbrush, for a clothes brush or for any other type of brush. It is equally possible to select, practically at will, the cross-sectional outlines of the tufts 5 as well as the distribution of tufts in an array 2. All that is necessary is to rearrange the discharge ends 12*a* of the conduits 10, 10A and to employ a different set of forms having sockets in a desired distribution.

If the improved apparatus is used for the making of paintbrushes of the type used by artists (with a single tuft of bristles), a form 7, 107 or 207 can be used for simultaneous making of a number of discrete paintbrushes. The end portions 8 of bristles 4 in each tuft 5 are then connected to one end of a discrete brush body in the form of an elongated handle. Such brushes can be made without resorting to covers 14, 114 or any other covers because the softened end portions 8 of bristles 4 in each of two or more tufts 5 in a main section 7*a* can be bonded directly to one end of an elongated handle-like brush body.

The apparatus of FIG. 14 differs from the apparatus of FIG. 1 (a) in that it employs covers 14 with the aforediscussed projections or protuberances 33 and (b) in that it employs a modified support 120 for the discharge ends 12*a* of the conduits 10. The passages 111 of the support 120 contain flow restrictors 34 in the form of venturis which cause desirable acceleration of bristles 4 on their way from the conduits 10 into the sockets 6 of the form 7 at the station 29*a*. Each passage 111 narrows in a direction from the discharge end 12*a* of the respective conduit 10 toward the cover 14, and its width thereupon increases gradually (at 35) to form a throat approximately midway between the upper side and the underside of the support 120.

The support 120 of FIG. 14 will be put to use when certain bristles 4 of tufts 5 in the conduits 10 exhibit a tendency to lag behind the other bristles. For example, the outer bristles of a tuft (namely those which contact the internal surface of the respective conduit 10) tend to lag behind the bristles at the center of the respective tuft. The flow restrictors 34 effect an acceleration of all bristles in the tufts 5 to thus further increase the likelihood that the leading end of each and every bristle will reach the bottom surface 21 in the respective socket 6 of the form 7. In other words, the flow restrictors 34 ensure that the kinetic energy of each bristle in a tuft suffices to guarantee predictable introduction into the corresponding socket 6. The utilization of flow restrictors upstream of the sockets 6 is possible because the bristles 4 are drawn into the sockets 6 by suction rather than being propelled into the sockets by compressed air or another compressed gaseous fluid. The bristles of tufts which are propelled by a compressed gaseous fluid will tend to pile up ahead of a flow restrictor; therefore, apparatus wherein tufts of bristles are transported by compressed air are provided with means for securing the bristles of each tuft to each other prior to pneumatic transport of the tufts to the brush forming station.

If a bristle 4 of a tuft 5 which contains several bristles or a very large number of bristles fails to fully enter the corresponding socket or does not enter the socket at all, it is simply converted into a mass of softened plastic material under the action of the heating device 25 and such mass is bonded to the end portions 8 of neighboring (properly inserted) bristles 4 to even further enhance the stability and reliability of the bond between the end portions 8 of bristles in a tuft which is anchored in the cover or directly in the body of a brush.

The apparatus of FIG. 14 can be used with particular advantage for the making of brushes wherein some or all of the sockets in a form are to receive very small numbers of bristles or individual bristles. It has been found that the flow restrictors 34 invariably ensure predictable penetration of discrete bristles all the way into abutment with the bottom surfaces 21 in the respective sockets 6. Moreover, the flow restrictors 34 can center the leading ends of the bristles 4 which are about to enter the respective sockets 6 to thus ensure that each such bristle invariably enters the respective aperture 6*a* and is not likely to jam prior to entering the blind hole 6*c* in the main section 7*a* of the form 7 at the station 29*a*.

The sockets of a form will receive discrete bristles if the bristles are very stiff (e.g., for the purpose of heavy-duty scrubbing) and/or when the leading ends of the bristles (i.e., those ends which are exposed when the brush is finished) are provided with enlargements in the form of spheres or the like. Such brushes are often used for massaging. The end portions 8 of individual bristles are deformed (enlarged) in the aforedescribed manner (preferably by softening as a result of heating) and are bonded to the cover and, if necessary, to the end portions 8 of adjacent discrete bristles or tufts of bristles. The provision of projections or protuberances 33 of thermoplastic material also contributes to reliable anchoring of end portions 8 of discrete bristles.

FIG. 15 shows a portion of an apparatus wherein the conduits 10, 10A are omitted and the transfer member 17 forms part of a means 37 for mechanically conveying tufts 5 of bristles 4 (and/or discrete bristles) from one or more magazines 15 to positions of register with the apertures 6*a* of the cover 14 at the station 29*a*. The apparatus 1 of FIG. 15 preferably further comprises a plate-like guide 38 with openings 39 in the form of cylindrical or otherwise configurated holes or bores each of which registers with the enlarged portion 6*b* of a discrete aperture 6*a* in the cover 14 at the station 29*a*. The motor 17*a* is designed to move the transfer member 17 between at least one first position in which the pockets 18 (not shown in FIG. 15) of the transfer member receive bristles 4 from the adjacent magazine or magazines 15, and at least one second position in which the tufts 5 in the recesses of the transfer member register with the openings 39 of the guide 38 and hence with the sockets 6 of the form 7 at the station 29*a*.

The lower end portions of the bristles 4 can slide along the upper side of the guide 38 during transport from the magazine or magazines 15 to the station 29*a*. The directions (arrow 17A) of reciprocatory movement of the transfer member 17 are substantially at right angles to the longitudinal directions of bristles in the pockets of the member 17. The guide 38 can be fixedly mounted in the frame of the brush making apparatus 1 or is reciprocable or otherwise movable to and from the operative position of FIG. 15 in which its openings 39 register with the apertures 6*a* of the cover 14 at the station 29*a*.

The apparatus 1 of FIG. 15 will be used when it is desirable and possible to place the source of bristles 4 into close or immediate proximity of the form 7 which is to receive an array of tufts and/or discrete bristles. This apparatus is more compact and less expensive than the apparatus of FIG. 1 or 14 because it need not employ any conduits and the suction generating device (not shown in FIG. 15) merely serves to draw bristles 4 and/or tufts 5 of bristles from the pockets of the transfer member 17 into the registering sockets 6 of the form 7 at the station 29*a*. The transfer or introduction of bristles 4 into the sockets 6 is assisted by gravity if the apparatus is designed in such a way that the bristles and/or tufts 5 which are about to be drawn into the respective sockets 6 are located at a level above the cover 14.

Figure 16:
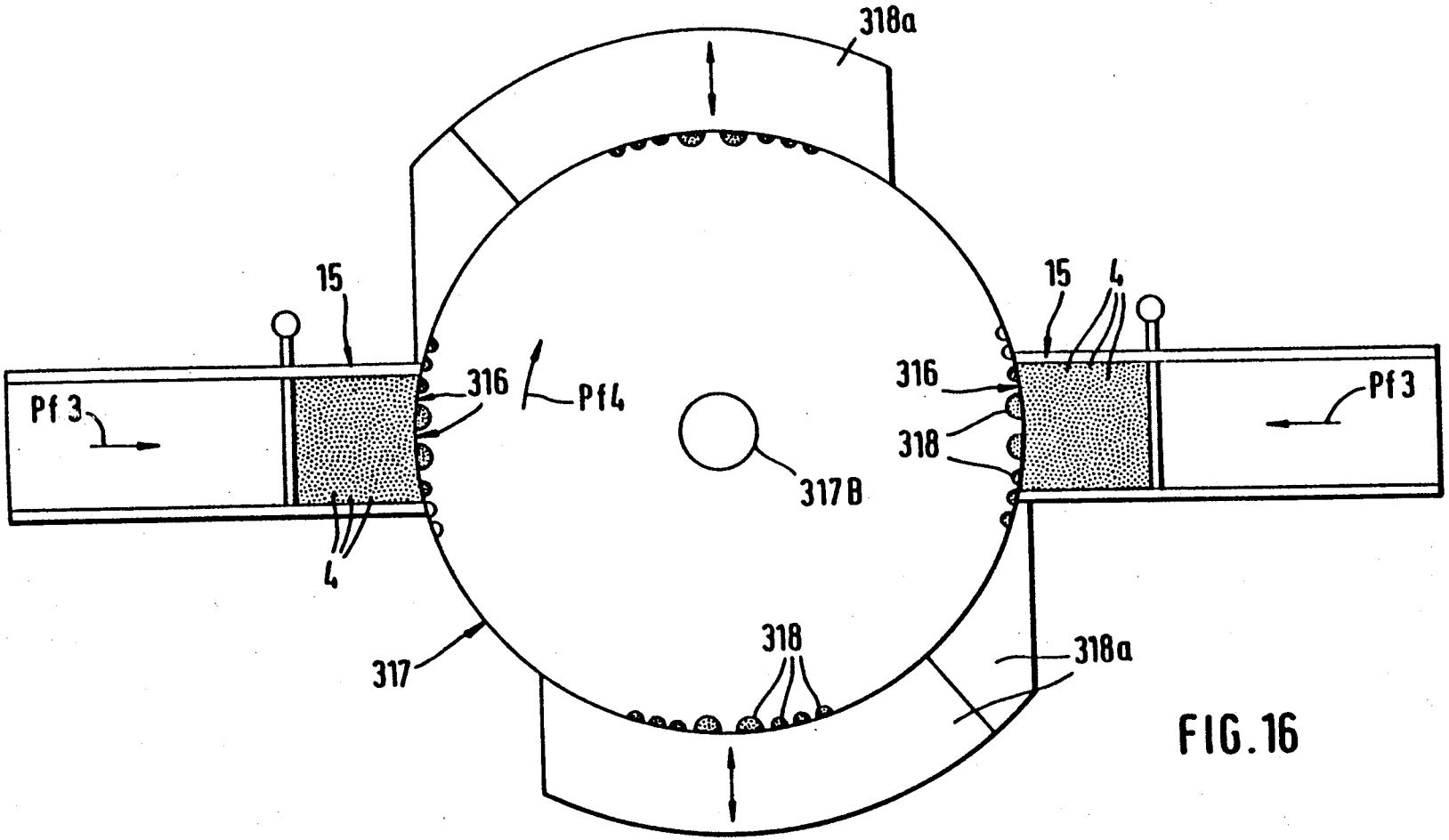
FIG. 16 is a plan view of a modified source of bristles wherein the transfer member is indexible to simultaneously withdraw sets of bristles and/or tufts from several magazines for delivery into alignment with conduits or directly with the sockets of several forms wherein the bristles are deformed and thereupon secured to brush bodies.

FIG. 16 shows a modified source of bristles which can be utilized in lieu of the source of FIG. 2 in apparatus of the type shown in FIGS. 1 and 14 (i.e., in apparatus with conduits for the transport of bristles and/or tufts of bristles from the transfer member to the form or forms at the station 29*a*) as well as in apparatus of the type shown in FIG. 15 (wherein the transfer member serves to advance bristles and/or tufts of bristles from one or more magazines directly to positions of register with sockets in one or more forms at the station 29*a*). The source of bristles which is shown in FIG. 16 comprises a rotary (e.g., disc-shaped) transfer member 317 with four sets of pockets 318 in its peripheral surface 316. The peripheral surface 316 seals the open sides of two magazines 15 which are disposed diametrically opposite each other with respect to the axis of rotation of the transfer member 317. The latter is indexible in the direction of arrow Pf4, always through angles of approximately or exactly 90°, and a substantial portion of its peripheral surface 316 abuts two arcuate walls 318*a* which prevent escape of bristles 4 from filled pockets 318 while such pockets advance from the open sides of the magazines 15 to locations (at the six and twelve o'clock positions of the transfer member 317, as viewed in FIG. 16) where the bristles and/or tufts of bristles are transferred from the pockets 318 into conduits (not shown in FIG. 16) or directly into the sockets of forms (not shown in FIG. 16). The transfer member 317 can deliver bristles 4 to two discrete sets of conduits or directly to two discrete forms. The means for indexing the transfer member 317 in the direction of arrow Pf4 comprises a shaft 317B and a motor (not shown) which drives the shaft 317B.

An advantage of the structure which is shown in FIG. 16 is that the transfer member 317 can furnish sets of bristles at frequent intervals because this transfer member need not be moved back and forth, i.e., each of its stepwise angular movements results in the delivery of two sets of bristles 4 to two sets of conduits or to the sockets of two forms.

The walls 318*a* are at least slightly retracted whenever that part of the conveying means which operates by suction is ready to draw bristles from the pockets 318 into the adjacent conduits or directly into the registering sockets of forms at the twelve and six o'clock positions of the indexible transfer member 317. This ensures that the bristles 4 can be withdrawn from the pockets 318 by suction. The same holds true for the walls 18*a* which are shown in FIG. 2.

The number of magazines 15 can be increased to three or more, depending upon the desired output of the brush making apparatus which embodies the structure of FIG. 16 and upon the diameter of the transfer member 317. The number of sets of pockets 318 in the peripheral surface 316 of the transfer member 317 is twice the number of magazines to thus ensure that one-half of the sets of pockets 318 receive bristles while the pockets of the other half of sets of pockets are in the process of maintaining the bristles in alignment with the bristle-receiving ends of conduits or with the openings of the corresponding guides 38 (not shown in FIG. 16). The number of magazines 15 can greatly exceed two; all that counts is to provide sufficient room between neighboring magazines for transfer of bristles from sets of filled pockets 318 into the registering conduits or into the sockets of forms. As shown in FIG. 16, the pockets 318 in the peripheral surface 316 of the indexible transfer member 317 need not be identical, i.e., each set of pockets can include one or more larger and one or more smaller pockets as well as pockets having a partly circular, a partly oval or a polygonal cross-sectional outline.

An important advantage of the improved method and apparatus is that it is not necessary to bond the bristles 4 of tufts 5 to each other prior to anchoring of tufts in the body of a brush. This is due to the fact that loose bristles 4 can be readily drawn into the sockets of a form to assume predetermined positions relative to each other and relative to the form. Conveying of loose bristles is not possible if the bristles are to be pneumatically advanced in one or more streams of compressed air or another gaseous fluid. All this contributes to a higher output of the apparatus and to higher quality of the brushes. The conveying of loose bristles by suction is predictable over short as well as over longer distances; as mentioned above, the conduits 10, 10A can have a length well in excess of five meters, e.g., in the range of ten meters. It has been found that misorientation of bristles is highly unlikely if the bristles are conveyed by suction rather than in one or more streams of compressed air Absence of misorientation practically eliminates the likelihood of clogging of conduits with misaligned bristles. Suction is or can be assisted by gravity during the last stage of conveying of bristles into the respective sockets if the sockets are substantially vertical with their open ends above and with the bottom surfaces below. All that is necessary is to ensure that the pockets 18 or 318 of the transfer member 17 or 317 are substantially vertical and that (if conduits 10 and/or 10A are used) the discharge ends 12*a* of the conduits are vertical to direct bristles 4 vertically downwardly into the registering sockets.

The utilization of one or more forms with adapters or covers also brings about a number of important advantages. For example, if the apertures (such as 6*a*) of a cover (6) have upwardly diverging portions (6*b*), the surfaces bounding the upwardly diverging portions steer the leading ends of bristles 4 into the smaller-diameter portions of the respective apertures and thence into the blind bores or holes of the main section of the respective form. This further reduces the likelihood of jamming at the open ends of the sockets and ensures that the leading ends of the bristles can advance all the way into abutment with the bottom surfaces in the registering sockets. The provision of conical or similar surfaces around the upper portions of apertures in the cover is particularly desirable if the apertures are to permit the passage of tufts (i.e., batches) of bristles.

The cover further serves to maintain the end portions 8 of tufts 5 of bristles in the respective sockets close to each other in order to ensure predictable enlargement (softening and deformation) of such end portions at the station 29*b* or at any other station where the end portions 8 are heated and thereupon bonded to each other, to the end portions of bristles in neighboring sockets and/or to the cover (e.g., to the projections 33 of a cover). Still further, the cover acts, or can act, as a heat barrier to prevent softening of those portions of bristles 4 which have entered the blind holes or bores of the main section of a form, namely to prevent softening of those portions of the bristles which are exposed in a finished brush and the appearance and/or any other desirable characteristics of which should not be affected by heat which is applied to soften the end portions 8 at the apertures of the cover. A further advantage of the cover is that it can be more readily secured to a brush body than discrete tufts of bristles or individual bristles. In addition, and as already described with reference to FIG. 9, each cover (214) can constitute or can form an integral part of a brush body, i.e., the making of a brush is completed as soon as the bristles and/or tufts or bristles are properly anchored in the cover. If the cover is a separate part which is thereupon welded, adhesively secured or mechanically affixed to a separately produced brush body, the cover can shield the major portions of bristles 4 from heat and/or adhesive during attachment of the cover (with the bristles anchored therein) to the brush body. This reduces the likelihood of spraying an adhesive substance and/or molten thermoplastic material onto the major portions of bristles, i.e., onto those portions of bristles in a toothbrush which come in contact with the teeth and gums of the user. Thus, in addition to performing the function of a thermal barrier, the cover can also serve as a means for shielding the major portions of bristles from contamination during those stages of brush making which follow the anchoring of end portions 8 of bristles 4 in the cover. Moreover, the cover ensures that those portions of bristles which extend beyond its underside (as seen in FIG. 1) are free to move relative to each other This guarantees that each bristle of a finished brush 3 exhibits a desired elasticity because it is free to move relative to the adjacent bristle or bristles all the way between its exposed end and the respective side of the cover. All this is possible in spite of the fact that the bristles are preferably anchored in the cover as a result of heating at least close to melting point of their material and subsequent welding to each other and/or to the cover.

If the cover are separately produced parts, they can be welded, adhesively bonded and/or mechanically secured (e.g., by screws, nails or bolts) to the bodies of the respective brushes. The exact nature of connection between a cover and the respective brush body will depend upon the size and desired appearance as well as upon the intended use of the brush.

The component *7a''* at the station *29b* of FIG. 4 renders it possible to draw molten material of the bristles 4 into the respective apertures by suction. Since the suction can be regulated with a high degree of accuracy, the apparatus employing a component *7a''* at the station *29b* ensures predictable filling of apertures *6a* with thermoplastic material of end portions 8 of the bristles to thus ensure the establishment of reliable bonds between the end portions 8 themselves as well as between such end portions and the respective cover. However, it is equally within the purview of the invention to force molten material of end portions 8 into the respective apertures *6a* by mechanical means and/or by a pressurized fluid. Thermoplastic material which sets in the apertures *6a* of a cover at the station *29b* maintains the bristles of the respective tufts in a desired orientation, and such thermoplastic material also serves as a seal which prevents penetration of germs, moisture, toothpaste, food particles, saliva and/or other foreign matter between a cover and the respective brush body.

Once a cover is properly secured to the respective brush body, the bristles which extend into the apertures of such cover are reliably held in optimum positions even if the end portions 8 of the bristles are not bonded to the cover (see FIG. 5). Thus, the connection between a cover and the respective brush body suffices to hold the bristles of the finished brush in proper positions relative to each other and relative to the brush body even if the bristles are not positively secured to the cover. It often suffices to install a cover in the respective brush body by friction; however, it is normally desirable to establish a more reliable and preferably permanent connection between a cover and a brush body. A more or less permanent connection is established by welding (e.g., high frequency welding), by the utilization of a suitable adhesive or by screws, nails or other fasteners. The establishment of a reliable connection between a cover and a brush body can or will result in at least some deformation of substantially spherical heads which are shown in FIG. 5 and are obtained as a result of melting of end portions 8 of bristles 4 which extend through the cover and into the blind bores or holes *6c* of the main section *7a* of the form 7. Such deformation of spherical formations consisting of molten end portions 8 of bristles 4 ensures reliable anchoring of tufts 5 in the body of the finished brush.

The covers can be used for the making of brushes which contain relatively soft (readily flexible) bristles, relatively stiff bristles or arrays of bristles having different characteristics including color, diameters, composition and/or others. All that is necessary is to properly distribute different types of bristles in two or more discrete magazines 15. Differently colored bristles will be used to enhance the appearance of the brushes and/or to form a symbol, e.g., the trademark of the maker, the initials of the maker and/or other information.

The utilization of two or more different types of bristles does not affect the output of the improved brush making apparatus. Thus, the source of FIG. 2 or the source of FIG. 16 can supply discrete bristles or batches of bristles at a high frequency irrespective of whether the plural magazines 15 contain identical or different bristles. Furthermore, and since the bristles which are conveyed to positions of alignment with the sockets of one or more forms are drawn into the respective sockets by suction, the means for drawing the bristles into the aligned sockets can effectively perform its function irrespective of whether the bristles which are about to be drawn by suction are black, white, transparent, opaque, short, long, thick or thin. If the means for drawing bristles into registering sockets also serves to draw bristles through conduits 10 and/or 10A, the likelihood of clogging of the conduits with bristles is practically nil, as long as the bristles are sufficiently flexible to undergo requisite deformation (flexing) during advancement through arcuate portions of the respective conduits. The passages 19 in the carrier 13 for the bristle-receiving ends 12 of the conduits 10 and/or 10A also contribute to a reduction of likelihood, or elimination, of clogging of receiving ends 12 with bristles, especially if the surfaces bounding the passages 19 are configurated in a manner as shown in FIG. 1. It has been found that the conveying of discrete bristles and/or batches of loose bristles from the source of bristles to the sockets of a form takes up surprisingly short intervals of time, even if the conduits are several meters long.

The flow restrictors 34 of FIG. 14 constitute an advantageous and desirable but optional feature of the improved brush making apparatus. It has been found that suction in the sockets of a form can cause all bristles of a tuft to enter the respective socket and to come into abutment with the respective bottom surface even if the speed of all bristles forming the tuft is not the same during advancement through a conduit 10 or 10A. In most instances, all bristles of a tuft will advance at the same speed; however, any stragglers will simply travel a little longer prior to coming into abutment with the bottom surface at the lower end of the respective socket. This also holds true if the apparatus does not employ any conduits between the source of bristles and the station 29*a* or an analogous station, e.g., if the bristles and tufts of bristles are transferred by mechanical means in a manner as described with reference to FIG. 15. Moreover, and as already described above, the exposed ends of tufts in a finished brush can assume a desired shape by the simple expedient of properly profiling the bottom surfaces which intercept the bristles and arrest the bristles in predetermined axial positions with reference to the corresponding form.

The support 20 or 120 can be moved relative to one or more forms at the station 29*a* by a fluid-operated motor or in any other suitable way. Similar motor or motors can be used to move the component 7*a*" at the station 29*a* relative to the conveyor 24, to move the component 7*a*" at the station 29*b* relative to the conveyor 24, to move the heating device 25 relative to the adjacent component 7*a*' and cover 14 at the station 29*b*, to move the device 27 at the station 29*d* and/or to move the ejector or ejectors for brushes 3 at the station 28 (provided that the apparatus does not employ only a pressurized fluid as a means for expelling the bristles of finished brushes 3 from successive components 7*a*' at the station 28).

The flow restrictors 34 of FIG. 14 can be used with advantage in apparatus wherein each socket 6 or certain sockets of the form 7 are to receive large numbers of bristles 4. The accelerating action upon the bristles 4 can be varied by replacing the illustrated support 120 with a support having a set of different flow restrictors which can effect a more pronounced or less pronounced acceleration of bristles on their way in the conduits 10 as well as on their way from the discharge ends 12*a* of the conduits 10 into the registering sockets 6. FIG. 14 further shows that the inner diameters of the conduits can match the diameters of upper portions of passages 19 in the carrier 13 for the bristle-receiving ends of the conduits.

The leading ends of the bristles 4 can be rounded to further reduce the likelihood of jamming in the passages 19 of the carrier 13 and/or in the apertures of a cover at the station 29*a*. Rounded leading ends of bristles are more likely to penetrate into narrow spaces between other bristles of a tuft 5 if one or more bristles lag behind the other bristles of a tuft during advancement along the path which is defined by the respective conduit 10 or 10A, i.e., even a slower bristle having a rounded leading end will be capable of reaching the respective bottom surface 21 because such rounded leading end will find its way between the bristles which already abut the bottom surface. Furthermore, if a bristle happens to project well beyond the end portions 8 of bristles which already abut a bottom surface 21, such projecting bristle is simply melted by the heating device 25 and ensures the establishment of a more reliable bond between the end portions 8 of other bristles or between such end portions and the cover 14.

The profiled bottom surfaces 21, 121 and 221 render it possible to dispense with the step of trimming the exposed ends of tufts 5 in a finished brush 3. This brings about substantially savings in time and equipment. Moreover, the profiled bottom surfaces ensure that the tips of tufts in each of a short or long series of successively and/or simultaneously produced bristles will have an optimum configuration which is complementary to the profiles of the respective bottom surfaces.

It has been found that the channels 123*a* and 223*a* which are shown in FIGS. 1*a* and 1*b* ensure predictable penetration of bristles 4 all the way into abutment with the respective bottom surfaces 121 and 221 even though the intake ends of these channels are not provided in the bottom surfaces. The reason is that the inertia of bristles which are in the process of entering the sockets 106 or 206 suffices to ensure that the leading ends of the bristles advance beyond the intake ends of the channels 123*a* or 223*a* and actually abut the bottom surfaces 121 or 221. On the other hand, the provision of channels with intake ends which are remote from the bottom surfaces 121 and 221 is desirable and advantageous because such channels are not likely to be clogged by the leading ends of bristles 4 even if the diameters of leading ends exceed the average diameters of the bristles. The pores of a foraminous insert which is made of sintered metallic or ceramic material, felt or the like are too small to permit penetration of leading ends of bristles; therefore, the bottom surfaces 21 can be provided on or in such inserts to thus ensure that the leading ends of the bristles can be drawn by suction all the way to the bottom surfaces.

The bottom surfaces can be profiled in such a way that they maintain the bristles in the respective sockets in any desired axial positions. For example, the depth of the valleys in the bottom surface 21 which is shown in FIG. 11*a* can be very small so that the differences between the effective lengths of bristles in the tufts of FIG. 11 are equally small. On the other hand, even such small differences can contribute to the appearance and/or utility of the finished brushes. For example, the cleaning action of a toothbrush having tufts 5 with shorter and longer bristles 4 in a distribution as shown in FIG. 11 is much more satisfactory than that of a toothbrush wherein all bristles of a tuft have identical lengths. Of course, the bottom surface 21 of FIG. 11*a* can have a concave, convex, sloping and/or other profile in addition to exhibiting the illustrated hills and valleys. This can even further enhance the utility of the finished product. For example, the distribution of bristles 4 in the longer tufts 5 of FIG. 10 can be similar to that of bristles in the tufts of FIG. 11, i.e., the free end or tip of a tuft 5 can have a rounded shape and, in addition, the free ends of bristles in the tuft need not form an ideal hemisphere but rather a hemisphere wherein some free ends project beyond the others to thus further enhance the cleaning effect and/or the appearance of the brush. Such profiling of the tips of tufts is much more complex and expensive if it is achieved as a result of trimming of tufts in a finished brush; on the other hand, mere profiling of bottom surfaces 21 suffices to ensure the formation of tufts with simple, more complex or very complex configuration of their tips. Forms (207) of the type shown in FIG. 1*b* can be used with particular advantage if the tips of tufts 5 are to be configurated in a rather specific way because a shifting of pistons 206*d* toward the open ends of the respective sockets 206 greatly reduces the likelihood that one or more bristles would be out of contact with the respective bottom surfaces 221 prior to bonding of end portions 8 of bristles to each other and/or to the cover.

The improved apparatus can employ a single magazine 15 or two or more magazines. Furthermore, each magazine 15 can cooperate with a discrete transfer member (such as 17), or a single transfer member (17 or 317) can draw bristles 4 from two, three or more magazines.

The appearance of the finished brushes can be enhanced by employing bristles 4 of different colors and/or by assembling covers having one or more first colors with brush bodies having one or more second colors. The surfaces bounding the apertures in the covers can be configurated in such a way that the bristles of a finished brush are substantially or exactly parallel to each other. Alternatively, these surfaces can be configurated to facilitate or cause at least some spreading of bristles (e.g., bristles of a tuft) in a direction from the cover toward the free ends of the bristles This might be desirable in certain brushes to enhance their cleaning, massaging and/or other effect. For example, so-called open tufts can be obtained in the lower portions of apertures 6*a* in the cover 14 of FIG. 1 are bounded by conical surfaces which diverge toward the main section 7*a* of the form 7. Such configurations can be achieved without resorting to so-called anchors which exert pressure upon individual bristles.

A further important advantage of the means for drawing bristles 4 by suction is that particles of dust which develop during grinding of bristles to impart to their leading ends a spherical shape is much less likely to continue to adhere to the bristles when the introduction of bristles into their sockets is completed. When a brush (e.g., a toothbrush) is produced in accordance with heretofore known methods, the bristles of the finished article often carry a rather large number of dust particles.

The introduction of bristles into sockets by suction and subsequent fixing of end portions 8 of introduced bristles to each other and/or to the cover renders it possible to dispense with the conventional anchoring of bristles and the resulting development of notches which can lead to cracks. Moreover, and since it is not necessary to develop notches, individual bristles are less likely to penetrate into notches and to project from other bristles in an orientation which is undesirable because it detracts from the appearance of the finished brush and also because the thus misoriented bristle does not contribute to the cleaning or other desirable action of the brush.

Each tuft of FIG. 5 can be used as part of a paintbrush, particularly an artists' brush. All that is necessary is to attach the spheres which are formed by the molten-together end portions 8 of bristles to the ends of suitable handles or to break up the cover 14 of FIG. 5 into sections and to use each section for attachment to a suitable handle.

The projections 33 which are shown in FIGS. 14 and 15 constitute optional features of the covers 14. If such projections are used, the device 25 of FIG. 4 must generate sufficient heat to soften or melt the projections and to thereupon deform the softened projections into engagement with softened end portions 8 of adjacent bristles 4. As already described with reference to FIG. 7, the deformed projections 33 can fill the spaces 6*b*′ between the enlarged portions 6*b* of apertures 6*a* in a cover 14 to thus ensure that the end portions 8 of all bristles and the deformed projections 33 together form a film or layer of hardened thermoplastic material which ensures a highly reliable anchoring of bristles in the cover 14 and hence in the body of the finished brush.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A method of making brushes from bristles in at least one form which is permeable to gaseous fluids and has bristle-receiving open-ended sockets, comprising the steps of establishing and maintaining at least one supply of bristles; conveying predetermined numbers of bristles from the at least one supply to the sockets of the at least one form, including drawing air from the sockets through the at least one permeable form so that the bristles are introduced into the sockets by suction and portions of the thus introduced bristles are located at the open ends of the respective sockets; and enlarging said portions of the bristles at the open ends of the respective sockets.

2. The method of claim 1, said bristles being made of thermoplastic material, wherein said enlarging step includes heating said portions of the bristles at least close to the melting point of the thermoplastic material of the bristles

3. The method of claim 1, wherein each of said predetermined numbers of bristles constitutes a tuft of at least substantially parallel bristles and said conveying step further comprises establishing for said tufts, discrete at least substantially sealed paths from the at least one supply to the respective sockets so that drawing of air from the sockets entails the advancement of tufts along the respective paths and into the respective sockets.

4. The method of claim 1, wherein said conveying step includes introducing the bristles into the respective sockets by moving the bristles substantially vertically downwardly so that said portions constitute the trailing upper ends of the introduced bristles.

5. The method of claim 1, wherein said at least one form has a main section with major parts of the sockets and a cover which overlaps the main section and has neighboring apertures constituting the open ends of the sockets, said portions of introduced bristles extending at least into the respective apertures of the cover.

6. The method of claim 5, wherein said enlarging step includes bonding said portions of the bristles to the cover.

7. The method of claim 5, wherein said enlarging step includes bonding said portions of bristles in neighboring apertures of the cover to each other.

8. The method of claim 5, wherein each of said predetermined numbers constitutes a tuft of at least substantially parallel bristles and said enlarging step includes bonding said portions of at least two bristles in each of said tufts to each other.

9. The method of claim 5, wherein said at least one form with a cover has at least one projection adjacent each of the apertures therein, said enlarging step includes bonding said portions of at least some introduced bristles to the adjacent projections of the cover.

10. The method of claim 5 wherein each aperture has a portion remote from and diverging in a direction away from the main section, said enlarging step including heating said portions of the bristles in the enlarged portions of the respective apertures.

11. The method of claim 5, said bristles being made of thermoplastic material, wherein said enlarging step includes heating said portions of inserted bristles at least close to the melting point of the thermoplastic material of the bristles so as to soften said portions of introduced bristles, and further comprising the step of at least partially forcing the softened portions of bristles into the respective apertures of the cover.

12. The method of claim 11, wherein said forcing step includes drawing the softened portions of introduced bristles into the respective apertures by suction.

13. The method of claim 11, wherein each of said predetermined numbers constitutes a tuft of substantially parallel bristles and said forcing step includes bonding the softened portions of bristles in each tuft to each other and/or to the cover.

14. The method of claim 5, further comprising the step of separating the cover and the bristles from the main section of the form.

15. The method of claim 14, further comprising the step of securing the separated cover and the bristles to a brush body.

16. The method of claim 15, wherein said securing step includes mechanically fastening the cover to the brush body.

17. The method of claim 15, wherein said securing step comprises welding the cover to the brush body.

18. The method of claim 15, wherein said securing step includes bonding the cover to the brush body with a adhesive.

19. The method of claim 14, further comprising the step of imparting to the cover the shape of a brush body, at least subsequent to said separating step.

20. Apparatus for making brushes from bristles, comprising at least one source of bristles; an assembling unit including at least one permeable form having bristle-receiving open-ended sockets; means for conveying predetermined numbers of bristles from said source to said sockets, including means for drawing air from said sockets through said form so that the bristles are introduced into the sockets by suction and portions of introduced bristles are located at the open ends of the respective sockets; and means for enlarging said portions of the bristles at the open ends of the respective sockets.

21. The apparatus of claim 20 said bristles being made of thermoplastic material, wherein said enlarging means includes means for heating said portions of introduced bristles at least close to the melting point of the thermoplastic material of the bristles.

22. The apparatus of claim 20, wherein said conveying means further comprises a conduit for each of said predetermined numbers of bristles, said conduits having receiving ends at said at least one source and discharge ends at the open ends of said sockets, said means for drawing air including means for advancing bristles by suction from the receiving ends toward and beyond the discharge ends of said conduits.

23. The apparatus of claim 22, further comprising means for effecting a relative movement between the discharge ends of said conduits and said form.

24. The apparatus of claim 22, wherein said at least one source includes means for maintaining said predetermined numbers of bristles in a first predetermined distribution and said receiving ends are in a distribution which matches said first distribution so that each of said receiving ends is in a position to receive one of said predetermined numbers of bristles, said sockets being in a second predetermined distribution and said discharge ends being in a distribution matching said second distribution so that each discharge end is in a position to admit one of said predetermined numbers of bristles into a discrete socket of said form.

25. The apparatus of claim 22, wherein each of said conduits is flexible, at least in the region of at least one of said ends thereof.

26. The apparatus of claim 25, wherein each of said conduits comprises a hose.

27. The apparatus of claim 22, wherein said conveying means further comprises a carrier for the receiving ends of said conduits.

28. The apparatus of claim 27, wherein said carrier has passages for said predetermined numbers of bristles and each of said passages communicates with and converges toward the receiving end of a discrete conduit.

29. The apparatus of claim 28, wherein each of said passages has a minimum diameter which substantially equals the inner diameter of the respective conduit.

30. The apparatus of claim 22, wherein said conveying means further comprises a support for the discharge ends of said conduits.

31. The apparatus of claim 22, further comprising flow restrictors between said conduits and the respective sockets.

32. The apparatus of claim 31, wherein each of said flow restrictors comprises or constitutes a venturi.

33. The apparatus of claim 22, wherein said at least one source comprises a plurality of magazines and means for transferring predetermined numbers of bristles from said magazines to the receiving ends of said conduits.

34. The apparatus of claim 22, wherein each of said conduits has an inner diameter in the range of 0.1 to 20 mm.

35. The apparatus of claim 22, wherein said unit comprises a plurality of forms and further comprising means for transporting said plurality of forms in a predetermined direction along a predetermined path having a first portion adjacent said discharge ends and a second portion adjacent said enlarging means downstream of said first portion.

36. The apparatus of claim 35, wherein said path has a third portion downstream of said second portion and further comprising a source of supply of brush bodies and means for delivering brush bodies from said source of supply to successive forms in the third portion of said path.

37. The apparatus of claim 35, wherein said path has a third portion downstream of said second portion and further comprising means for treating the bristles in successive forms in said third portion of said path.

38. The apparatus of claim 35, wherein said transporting means includes an endless conveyor having a first reach defining said first and second portions of said path and a second reach defining an additional portion of said path downstream of said second portion, and further comprising means segregating said predetermined numbers of bristles from the respective forms in the additional portion of said path.

39. The apparatus of claim 22, wherein said form includes a main section and a cover overlapping said main section, said main section having blind holes constituting portions of said sockets and said cover having apertures constituting the open ends of said sockets, said portions of introduced bristles in said sockets being located at the respective apertures of said cover.

40. The apparatus of claim 39, wherein said apertures include portions which are spaced apart from and diverge in a direction away from said main section.

41. The apparatus of claim 39, wherein each of said apertures communicates with at least one other aperture of said cover.

42. The apparatus of claim 20, wherein said at least one source comprises at least one magazine, and further comprising means for accumulating said predetermined numbers of bristles including at least one transfer member having bristle-receiving pockets and means for moving said transfer member between at least one first position in which at least some of said pockets receive bristles from said at least one magazine and at least one second position in which the bristle-containing pockets are located externally of said at least one magazine.

43. The apparatus of claim 42, wherein said conveying means further comprises conduits, one for each of said sockets and each having a receiving end in register with a bristle-containing pocket in the second position of said at least on transfer member.

44. The apparatus of claim 20, wherein said sockets are blind holes and said form has profiled bottom surfaces in said blind holes to intercept and arrest the introduced bristles in predetermined axial positions with reference to said form.

45. The apparatus of claim 20, wherein said drawing means comprises at least one suction channel provided in said form for each of said sockets and extending substantially laterally of and communicating with the respective socket, and means for evacuating air from said channels.

46. The apparatus of claim 45, wherein said evacuating means comprises a suction chamber, said channels having intake ends communicating with the respective sockets and discharge ends communicating with said chamber.

47. The apparatus of claim 20, wherein said form includes at least one foraminous insert adjacent said sockets and said drawing means includes means for evacuating air from said sockets through said at least one insert.

48. The apparatus of claim 47, wherein said evacuating means includes a suction chamber provided in said form adjacent said at least one insert.

49. The apparatus of claim 20, wherein each of said sockets forms part of a discrete cylinder chamber provided in said form and said form further comprises a piston extending into each of said cylinder chambers and constituting an abutment for bristles which are introduced into the respective socket, said form further having means for moving said pistons in the respective cylinder chambers to thus vary the effective depth of said sockets and to select the positions of said portions of introduced bristles with reference to the open ends of the respective sockets.

50. The apparatus of claim 20, wherein said form has bottom surfaces in said sockets, said bottom surfaces being remote from the open ends of the respective sockets and at least one of said bottom surfaces having at least one hill and at least one valley so that the bristles which are introduced into the socket adjacent said one bottom surface abut said hill or said valley and are thus staggered in the respective socket.

51. The apparatus of claim 20, wherein said unit comprises at least two forms each of which has a plurality of sockets, said conveying means further comprising conduits defining discrete paths for simultaneous delivery of bristles from said source to the sockets of each of said forms.

52. The apparatus of claim 20, wherein said conveying means further comprises means for receiving bristles from said at least one source, for gathering the thus received bristles into tufts containing different numbers of bristles and for delivering said tufts to said sockets.

53. The apparatus of claim 20, wherein said at least one source comprises a plurality of magazines and means for simultaneously withdrawing tufts of bristles from said magazines.

54. The apparatus of claim 53, wherein said magazines include a first and a second magazine and said withdrawing means comprises a transfer member disposed between said first and second magazines and having first and second sides adjacent said first and second magazines, each of said sides having at least one bristle-receiving pocket and further comprising means for moving said transfer member between at least one first position in which said pockets receive bristles from the respective magazines and at least one second position in which the bristle-containing pockets are spaced apart from said magazines.

55. The apparatus of claim 20, wherein said form includes a main section and a cover overlapping and being separable from said main section, said sockets including portions in said main section and said cover having apertures constituting the open ends of said sockets, said cover having a flange surrounding a recess of a brush body.

56. The apparatus of claim 55, wherein said cover consists of a material which is the material of the brush body, said cover being detachable from said main section together with the introduced bristles upon completed enlargement of said portions of inserted bristles.

57. The apparatus of claim 20, wherein said form includes a main section and a cover which is detachable from the main section with the introduced bristles and constitutes a brush body.

58. The apparatus of claim 20, wherein said conveying means further comprises means for mechanically advancing predetermined numbers of bristles from said source to said sockets.

59. The apparatus of claim 58, wherein said advancing means comprises a transfer member and means for moving said transfer member between at least one first position in which said member receives predetermined numbers of bristles from said source and at least one second position in which the thus received bristles are aligned with the sockets of said form.

60. The apparatus of claim 59, further comprising guide means having openings in register with the open ends of said sockets, at least in said at least one second position of said transfer member, and said guide means being disposed between said open ends and said transfer member in said at least one second position of said transfer member so that said drawing means can introduce bristles into said sockets through the openings of said guide means.

61. The apparatus of claim 58, wherein said form has at least one foraminous insert adjacent said sockets and said drawing means includes means for evacuating air from said sockets through said at least one insert.

62. The apparatus of claim 58, wherein said form includes a main section and a cover overlapping and being separable from said main section, said sockets having portions in said main section and said cover having apertures constituting the open ends of said sockets, said cover comprising thermoplastic projections adjacent said apertures and said enlarging means including means for bonding said portions of at least some introduced bristles to the adjacent projections of said cover.

63. The apparatus of claim 20, wherein said at least one source comprises at least one magazine and further comprising an indexible transfer member having bristle-receiving pockets, and means for indexing said transfer member between at least one first position in which at least some of said pockets receive bristles from said at least one magazine and at least one second position in which the bristle-containing pockets are spaced apart from said at least one magazine.

64. The apparatus of claim 63, wherein said at least one source comprises a plurality of magazines and said pockets form sets of pockets, said transfer member being indexible in a single direction between a plurality of first and second positions in each of which several sets of pockets receive bristles from said magazines and several sets of bristle-containing pockets are spaced apart from said magazines.

65. The apparatus of claim 64, wherein said transfer member is indexible through angles of approximately 90°.

66. The apparatus of claim 65, wherein said at least one source comprises two magazines which are located substantially diametrically opposite each other with reference to said transfer member.

67. The apparatus of claim 63, wherein said transfer member has a peripheral surface and said pockets are open substantially axially parallel recesses in said peripheral surface.

68. The apparatus of claim 63, wherein said transfer member is a rotary disc.

69. The apparatus of claim 63, wherein the bristle-containing pockets register with said sockets in the at least one second position of said transfer member.

70. The apparatus of claim 63, wherein said conveying means further comprises conduits which establish paths for advancement of bristles from bristle-containing pockets to said sockets in said at least one second position of said transfer member.

* * * * *